US008968007B2

(12) United States Patent
Kuwahara et al.

(10) Patent No.: US 8,968,007 B2
(45) Date of Patent: Mar. 3, 2015

(54) CONNECTOR AND FABRICATION METHOD THEREOF

(71) Applicant: Japan Aviation Electronics Industry, Limited, Shibuya-ku, Tokyo (JP)

(72) Inventors: Takashi Kuwahara, Tokyo (JP); Seiya Matsuo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 3 days.

(21) Appl. No.: 13/920,008

(22) Filed: Jun. 17, 2013

(65) Prior Publication Data

US 2013/0344742 A1 Dec. 26, 2013

(30) Foreign Application Priority Data

Jun. 26, 2012 (JP) ..... 2012-143353

(51) Int. Cl.

| | |
|---|---|
| ***H01R 12/00*** | (2006.01) |
| ***H01R 12/70*** | (2011.01) |
| ***H01R 43/00*** | (2006.01) |
| ***H01R 12/71*** | (2011.01) |
| ***H01R 12/73*** | (2011.01) |
| ***H01R 43/20*** | (2006.01) |

(52) U.S. Cl.

CPC ..... *H01R 12/7076* (2013.01); *H01R 43/00* (2013.01); *H01R 12/714* (2013.01); *H01R 12/73* (2013.01); *H01R 43/205* (2013.01)

USPC ..... 439/66

(58) Field of Classification Search

USPC ..... 439/91, 66

See application file for complete search history.

(56) References Cited

U.S. PATENT DOCUMENTS

| | | | | |
|---|---|---|---|---|
| 7,467,951 | B2 * | 12/2008 | Hougham et al. | 439/66 |
| 7,549,870 | B2 * | 6/2009 | Mason et al. | 439/66 |
| 7,549,871 | B2 * | 6/2009 | Pennypacker et al. | 439/66 |
| 8,109,768 | B2 * | 2/2012 | Nikaido et al. | 439/66 |

FOREIGN PATENT DOCUMENTS

| | | |
|---|---|---|
| JP | 2002-057416 A | 2/2002 |
| JP | 2009-038171 A | 2/2009 |
| JP | 2011-086590 A | 4/2011 |

* cited by examiner

*Primary Examiner* — Phuong Dinh

(74) *Attorney, Agent, or Firm* — Holtz, Holtz, Goodman & Chick PC

(57) ABSTRACT

Provided is a connector which ensures a sufficient contact pressure at a low cost and has a long connection life and also provide a fabrication method the connector. The connector 10 comprises a base member 100 and the contacts 200 projecting upwards and downwards of the base member 100. Openings 110 formed on the base member 100 extend in the direction crossing the pitch direction of the contacts 200. The contact 200 has an elastic-support member 220 and a contact film 260 pasted on the elastic-support member 220. The contact film 260 faces the opening 110 so that length of the contact film 260 can be larger than interval between the contacts 200 in the pitch direction. The contact 200 absorbs variations of a size of pads of the connection objects.

14 Claims, 18 Drawing Sheets

CONNECTOR AND FABRICATION METHOD THEREOF

CROSS REFERENCE TO RELATED APPLICATIONS

An applicant claims priority under 35 U.S.C. §119 of Japanese Patent Application No. JP2012-143353 filed Jun. 26, 2012.

BACKGROUND OF THE INVENTION

The present invention relates to a connector configured to make a connection between pads of boards or a connection between an LGA (Land Grid Array) package and a pad of a board.

This kind of connector is disclosed in, for example, JP-A 2009-38171 (Patent Document 1), JP-A 2002-57416 (Patent Document 2) and JP-A 2011-86590 (Patent Document 3).

As shown in FIG. 28 and FIG. 29, each of the connectors disclosed in Patent Document 1 and Patent Document 2 is made by forming a conductor 2 on an insulation-base body 1 which has a sheet-shape, and bending the conductor 2 together with the insulation-base body 1.

As shown in FIG. 30, the connector of Patent Document 3 has an insulation-elastic sheet 5 which has projection portions 4 and 4', and through holes 7. A conductor 6 is plated on the projection portion 4, an inner side of the through hole 7, and the opposite projection portion 4'. The conductor 6 serves as a contact 3. A part of the conductor 6 which is positioned between the projection portion 4 and the through hole 7 extends in an angle of about 45 degrees so that stress applied to the contact 3 is reduced.

In Patent Document 1, height of the contact is determined by length of the conductor 2 (length of the conductor 2 which is spread out), and the length is determined by an interval between the contacts. In detail, if the interval between the contacts is small, the height of the contact would not be large. As a result, a sufficient contact pressure is not ensured, or the contact may not follow deformation of a board.

The connector of Patent Document 2 is not suitable for the connection with pads, such as pads of an LGA package, arranged in the matrix form.

The connector of Patent Document 3 has a problem that manufacturing process is complicated and requires a high cost. Stress is concentrated on a bent-portion of the conductor 6 positioned in the vicinity of the through hole 7. Thus, the conductor 6 may be broken.

SUMMARY OF THE INVENTION

It is an object of the present invention to provide a low cost connector which ensures a sufficient contact pressure and has a long connection life. It is also an object of the present invention to provide a fabrication method of the connector.

One aspect of the present invention provides a connector comprising: a base member having a plurality of contact-attachment portions and a plurality of openings, the contact-attachment portions being arranged in a matrix form that has a plurality of columns in a first horizontal direction and a plurality of rows in a second horizontal direction crossing the first horizontal direction, the openings corresponding to the contact-attachment portions, each of the openings piercing the base member in a vertical direction perpendicular to both the first horizontal direction and the second horizontal direction, each of the openings extending in a predetermined direction crossing both the first horizontal direction and the second horizontal direction in a horizontal plane which is defined by the first horizontal direction and the second horizontal direction; and a plurality of contacts held by the base member and arranged in the matrix form, each of the contacts comprising an elastic-support member and a contact film, the elastic-support member having an upper end, an attachment surface and a lower end, the upper end and the lower end being opposite ends of the elastic-support member in the vertical direction, the attachment surface being positioned between the upper end and the lower end and facing the opening, the elastic-support member being attached to the corresponding contact-attachment portion and projecting upwards and downwards from the base member, the contact film comprising an insulation film and a conductive portion formed on the insulation film, the insulation film being positioned between the elastic-support member and the conductive portion, the conductive portion facing the opening and extending over the upper end, the attachment surface and the lower end of the corresponding elastic-support member.

Another aspect of the present invention provides a fabrication method of a connector which has a plurality of contacts and a base member holding the contacts, comprising: forming an elastic-base member to the base member, the base member having a plurality of contact-attachment portions and a plurality of openings, the contact-attachment portions being arranged in a matrix form that has a plurality of columns in a first horizontal direction and a plurality of rows in a second horizontal direction crossing the first horizontal direction, the openings corresponding to the contact-attachment portions, each of the openings piercing the base member in a vertical direction perpendicular to both the first horizontal direction and the second horizontal direction, each of the openings extending in a predetermined direction crossing both the first horizontal direction and the second horizontal direction in a horizontal plane which is defined by the first horizontal direction and the second horizontal direction, the elastic-base member having at least two elastic-support members and a connection portion which connects between the elastic-support members, each of the elastic-support members being attached to the contact-attachment portion and having an upper end, a lower end and an attachment surface, the upper end and the lower end being opposite ends of the elastic support member in the vertical direction, the attachment surface being provided between the upper end and the lower end and facing the opening; removing the connection portion; preparing a plurality of contact films each of which has a support portion made of insulation material, and a conductive portion formed on the support portion; and forming the plurality of contacts by attaching the contact films to the elastic-support members so that the conductive portion faces the opening and extends over the upper end, the attachment surface and the lower end of the elastic-support member.

An appreciation of the objectives of the present invention and a more complete understanding of its structure may be had by studying the following description of the preferred embodiment and by referring to the accompanying drawings.

Figure 1:
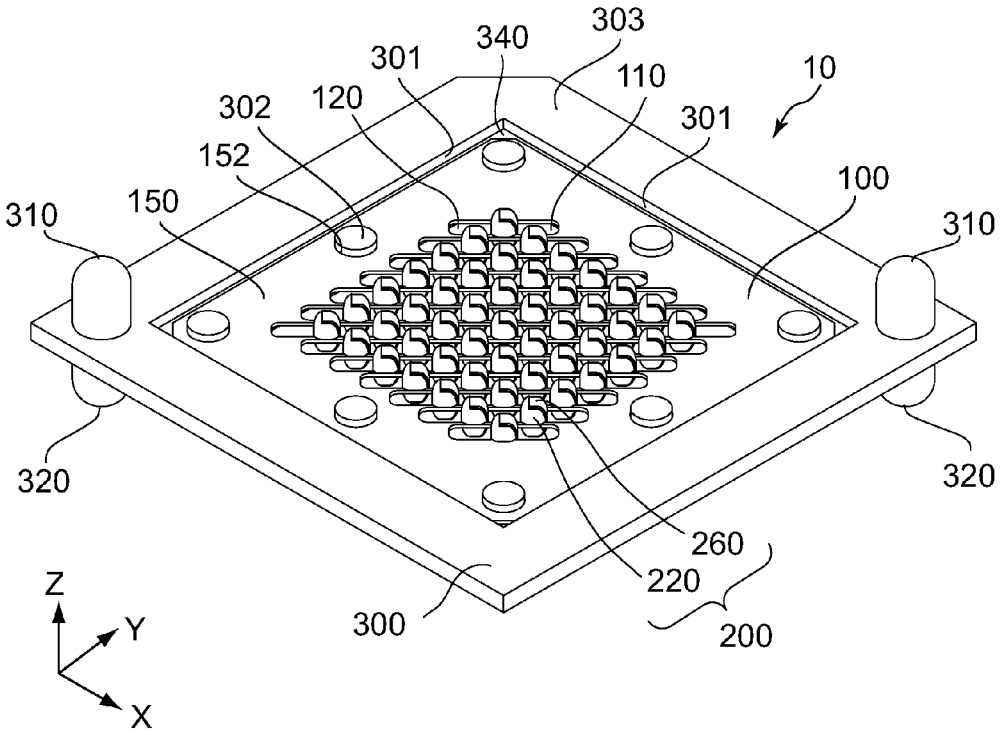
FIG. 1 is an oblique view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 16:
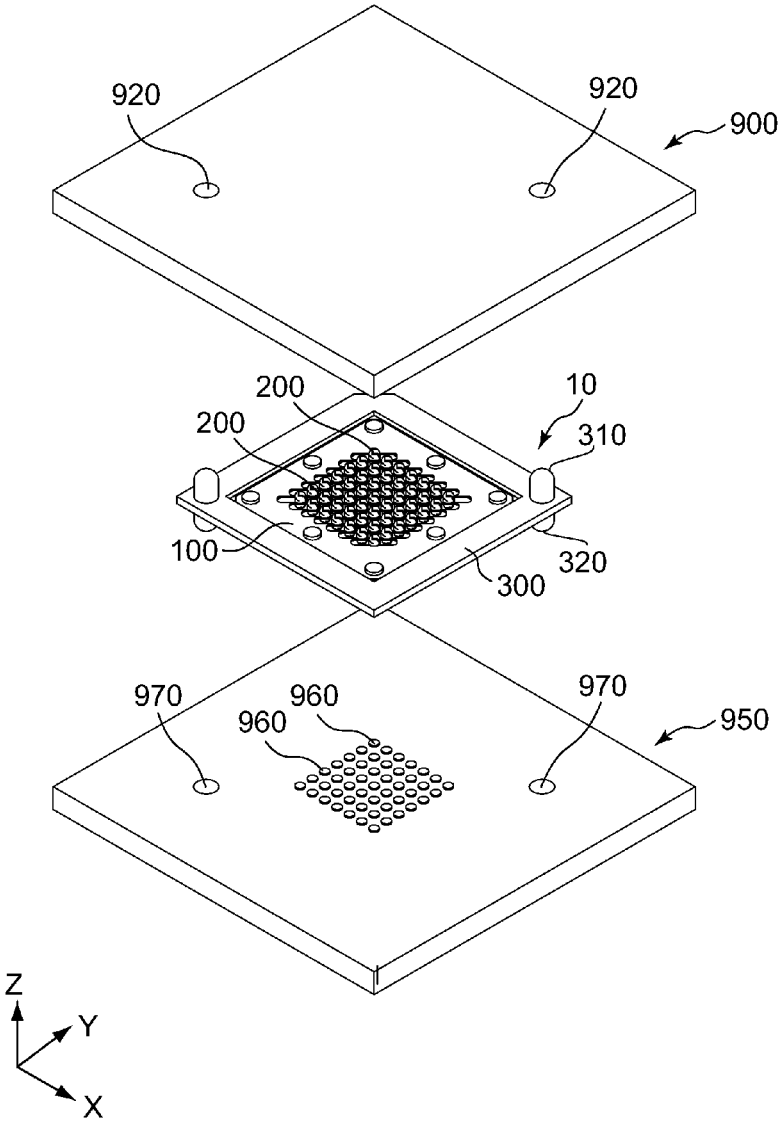
FIG. 16 is an oblique view showing the connector of FIG. 1. The connector is positioned between an upper board and a lower board.
Figure 26:
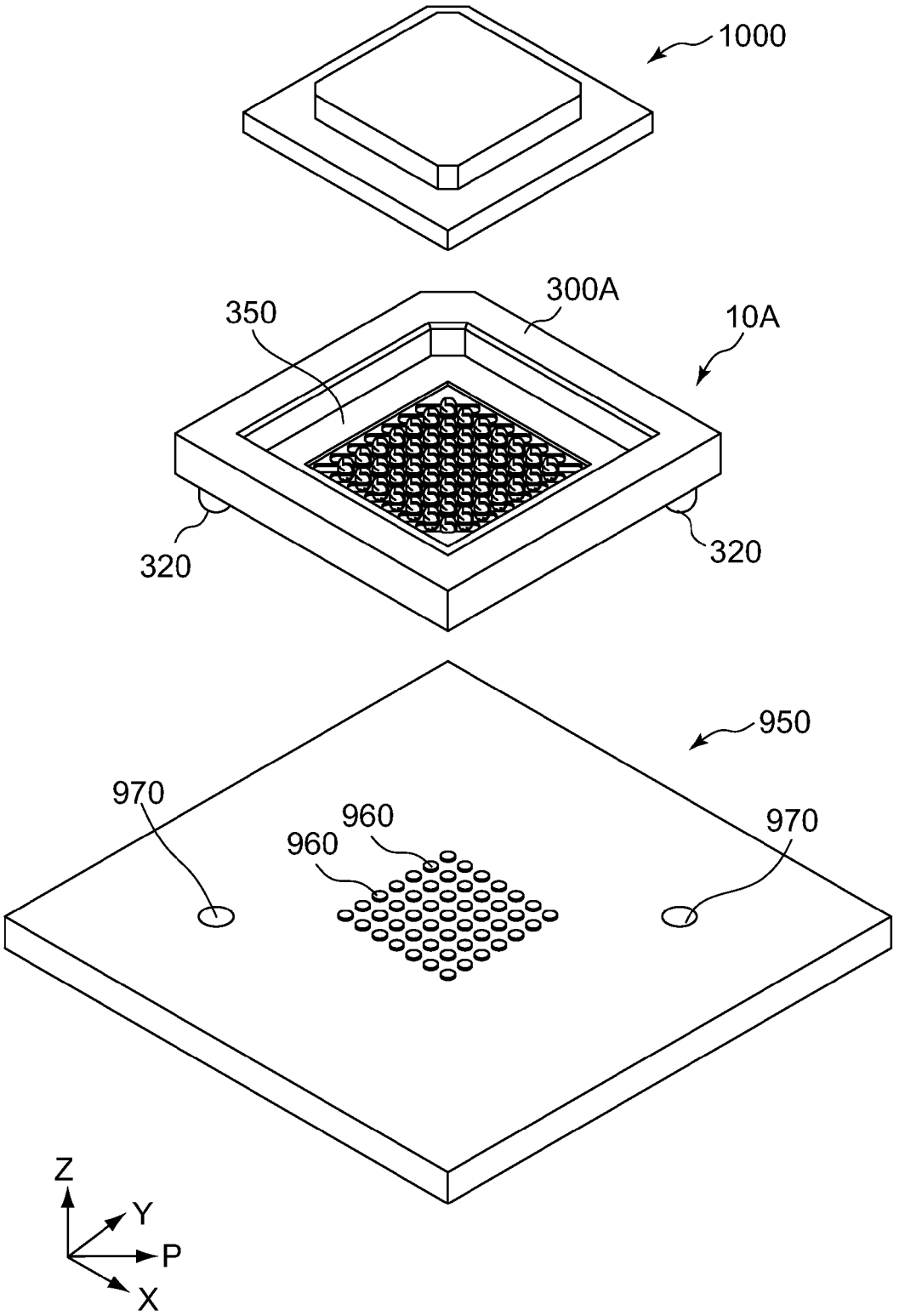
FIG. 26 is an oblique view showing the connector of FIG. 24. The connector is positioned between an LGA package and the lower board.
Figure 27:
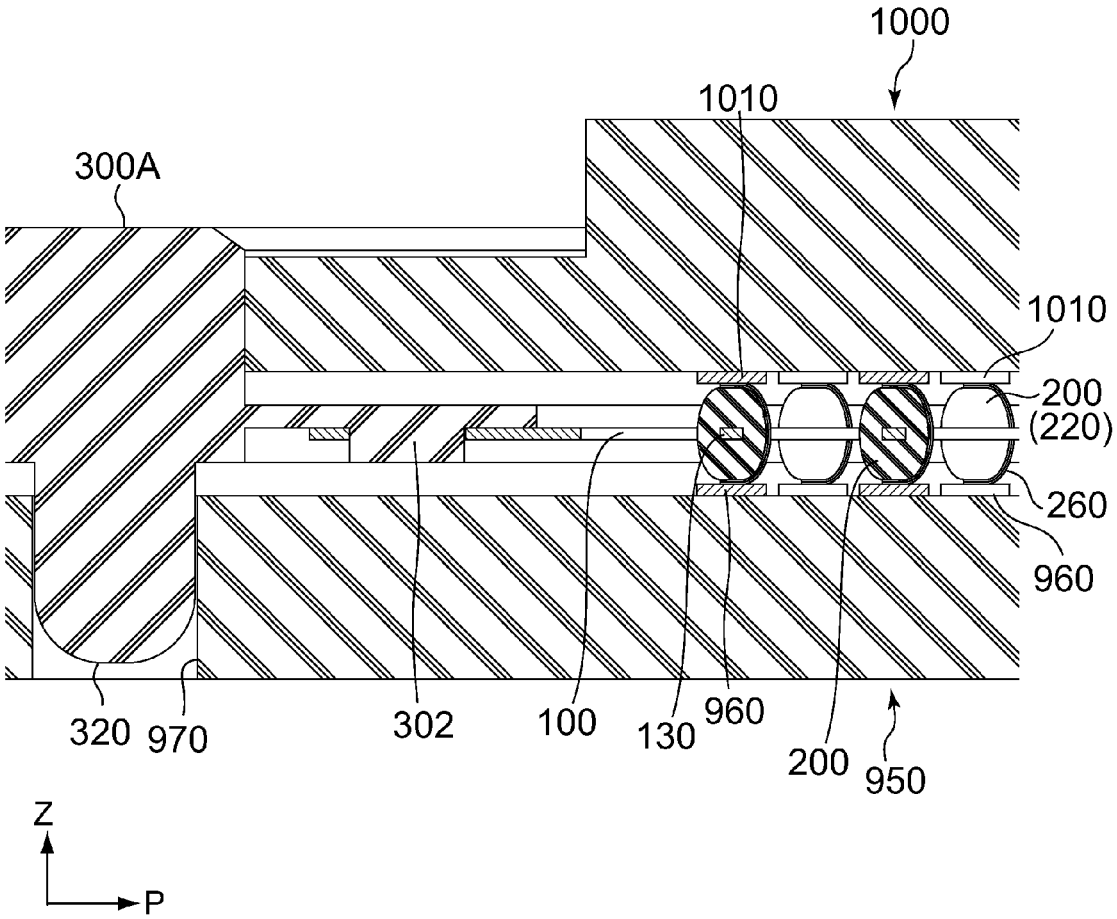
FIG. 27 is a cross-sectional view showing the connector of FIG. 24. The connector is put between the LGA package and the lower board.
Figure 28:
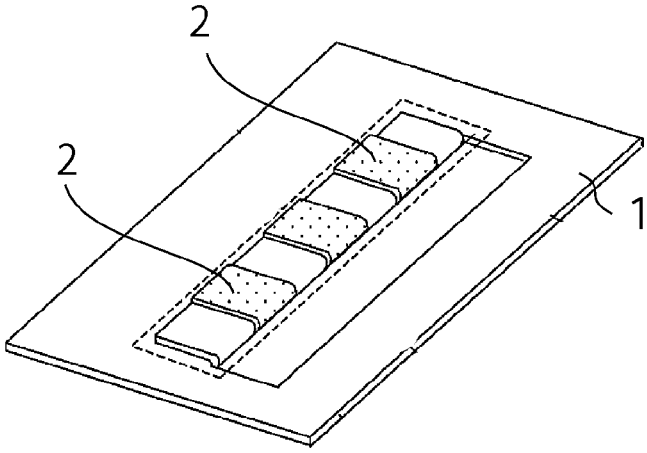
FIG. 28 PRIOR ART
FIG. 28 showing a connector disclosed in Patent Document 1.
Figure 29:
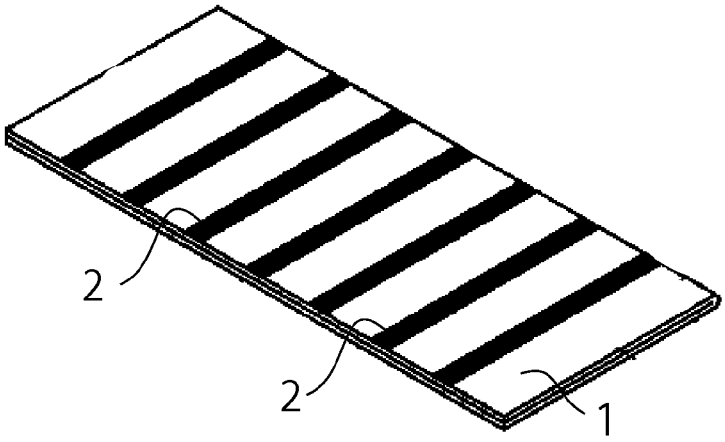
FIG. 29 PRIOR ART
FIG. 29 showing a connector disclosed in Patent Document 2.
Figure 30:
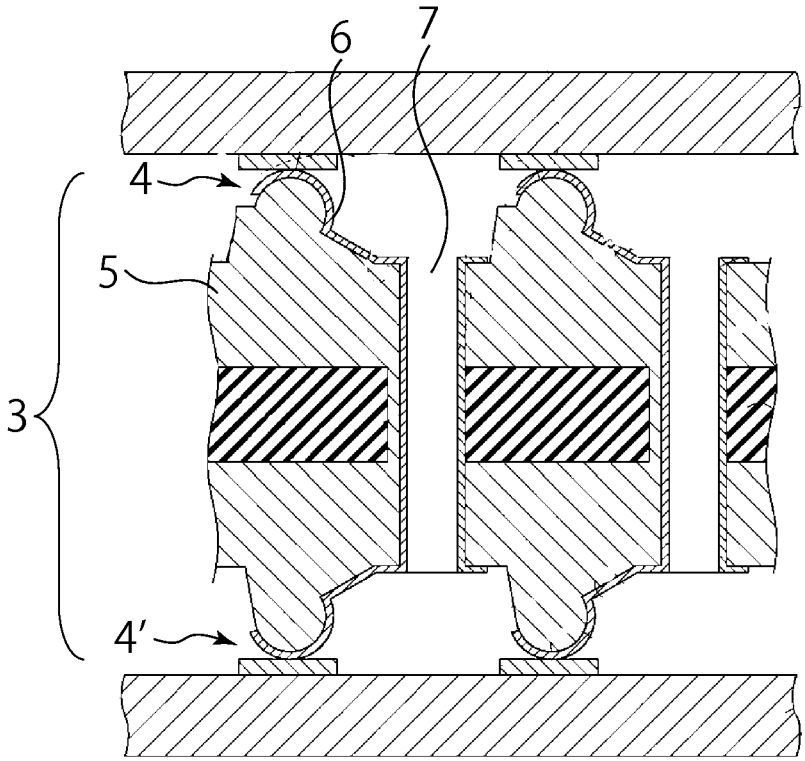
FIG. 30 PRIOR ART
FIG. 30 showing a connector disclosed in Patent Document 3.

With reference to FIG. 1, FIG. 16 and FIG. 26, a connector 10 according to an present embodiment of the present invention is configured to electrically connect pads (not shown) of a board 900 or pads (not shown) of an LGA package 1000 with pads 960 of a board 950. Each of the board 900 and the LGA package 1000 is arranged above (+Z side) the connector 10 while the board 950 is arranged under (−Z side) the connector 10.

As shown in FIG. 1, the connector 10 of the present embodiment comprises a base member 100, a plurality of contacts 200 held by the base member 100 and a frame 300 holding the base member 100. The contacts 200 are arranged in a matrix form that has a plurality of columns in an X direction (a first horizontal direction) and a plurality of rows in a Y direction (a second horizontal direction). The connector 10 of the present embodiment has forty-nine contacts 200 in total. The contacts 200 are arranged in a matrix form with 7 rows and 7 columns.

Figure 2:
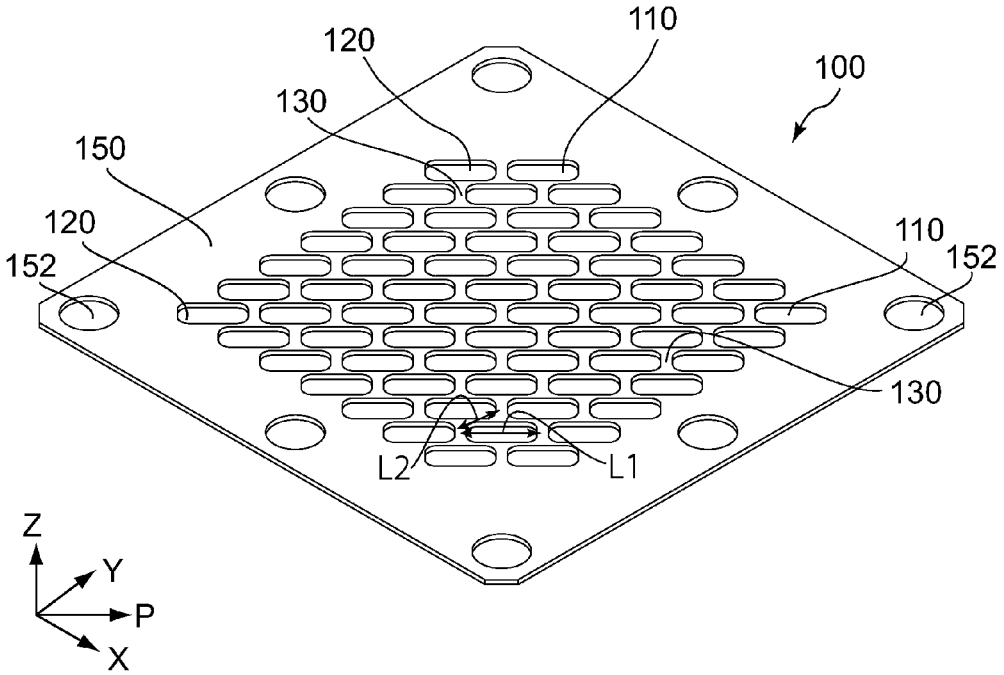
FIG. 2 is an oblique view showing a base member of the connector of FIG. 1.

As shown in FIG. 1 and FIG. 2, the base member 100 has a plate-like shape. In detail, the base member 100 has a square tile-shape. The base member 100 comprises a plurality of openings (openings 110 and rear-openings 120: described later) and a plurality of contact-attachment portions 130. Similarly to the contacts 200, the contact-attachment portions 130 are arranged in the matrix form. The base member 100 is made of a metal sheet. A surface of the metal sheet is insulated, for example, by an insulation coating or the like.

As shown in FIG. 2, the contact-attachment portion 130 is positioned between the opening 110 and the rear-opening 120. The openings 110 (the rear-openings 120) pierce the base member 100 in a Z direction (a vertical direction).

Figure 4:
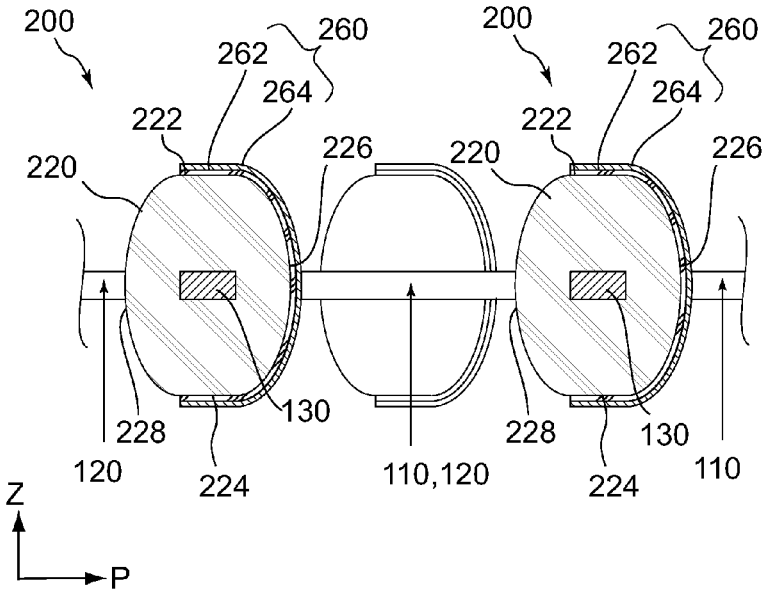
FIG. 4 is a partial, cross-sectional view showing a cross-section taken along a predetermined direction P.

As understood from FIG. 4, the opening 110 of the left contact-attachment portion 130 and the rear-opening 120 of the right contact-attachment portion 130 are formed as one opening. In other words, the opening positioned between the neighboring contact-attachment portions 130 in the predetermined direction P serves as the opening 110 for one of the contact-attachment portions 130 and also serves as the rear-opening 120 for the other one of the contact-attachment portions 130.

As seen from a different angle, the base member 100 has a plurality of long openings extending in the predetermined direction P. One or more contact-attachment portions 130 are provided in each of the long openings so as to divide the long opening into two or more openings in the predetermined direction P. Especially, in the long opening where two or more contact-attachment portions 130 are provided, the contact-attachment portions 130 are arranged at regular intervals in the predetermined direction P.

As understood from FIG. 1 and FIG. 2, the predetermined direction P crosses both the X direction and the Y direction in an XY plane (a horizontal plane). The openings 110 extend in the predetermined direction P. Therefore, a size L1 of the opening 110 in the predetermined direction P is larger than an interval L2 between the contact-attachment portions 130 in the X direction and in the Y direction.

The predetermined direction P of the present embodiment forms an angle of 45 degrees with both the X direction and the Y direction. The angle of 45 degrees can make the size L1 of the opening 110 largest in the predetermined direction P.

Figure 3:
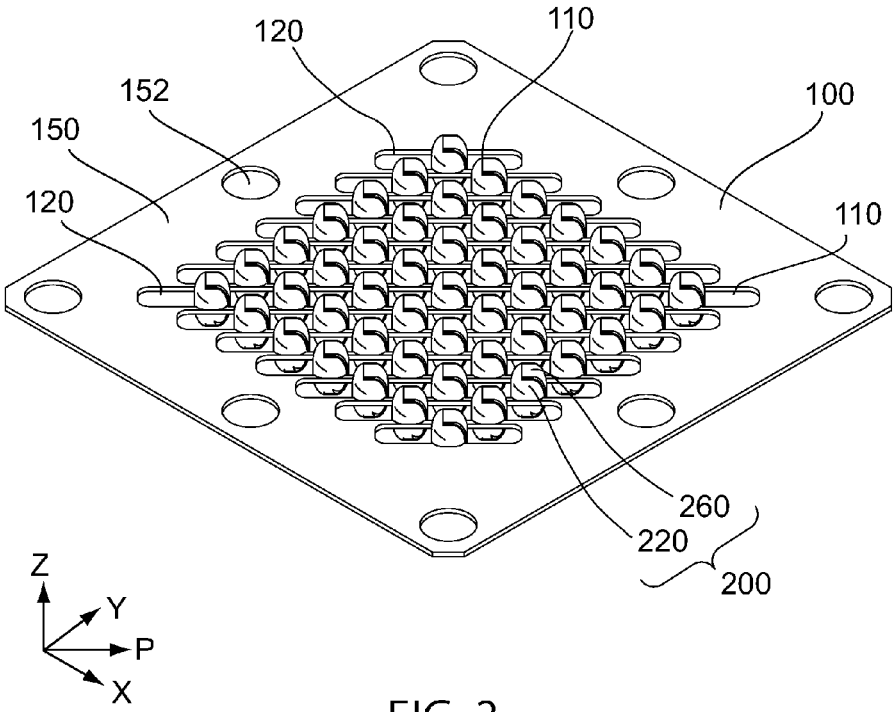
FIG. 3 is an oblique view showing the base member and contacts of the connector of FIG. 1.

As shown in FIG. 1, FIG. 3 and FIG. 4, the contact 200 has a barrel-like shape, and is attached to the contact-attachment portion 130 of the base member 100.

As best shown in FIG. 4, the contact 200 comprises an elastic-support member 220 and a contact film 260. The elastic-support member 220 has an upper end 222, an attachment surface 226, a lower end 224 and a rear surface 228. The upper end 222 and the lower end 224 are opposite ends in the Z direction (the vertical direction). The attachment surface 226 is provided between the upper end 222 and the lower end 224. The rear surface 228 is positioned opposite to the attachment surface 226 in the predetermined direction P.

The elastic-support member 220 is attached to the base member 100 so that the contact-attachment portion 130 is positioned at the center of the elastic-support member 220. In other words, the contact-attachment portion 130 is entirely embedded in the elastic-support member 220. According to this structure, the elastic-support members 220 are positioned with accuracy in the X direction and the Y direction. Moreover, the elastic-support members 220 are securely held and prevented from sliding from the contact-attachment portion 130.

The elastic-support members 220 project in the +Z direction (upwards) and the −Z direction (downwards) from the base member 100. In other words, the upper end 222 and the lower end 224 of each of the elastic-support members 220 are distant from the base member 100 in the Z direction. The contacts 200 absorb variations of sizes in the Z direction of pads of the connection objects (the boards 900 and 950: see FIG. 16) which are positioned on and under the contacts 200. Therefore, the contacts 200 are connected with the connection objects with reliability.

As shown in FIG. 4, the attachment surface 226 of the elastic-support member 220 faces the opening 110. The rear surface 228 faces the rear-opening 120. In other words, the elastic-support member 220 is positioned between the opening 110 and the rear-opening 120 in the predetermined direction P.

As shown in FIG. 3 and FIG. 4, the contact film 260 has a rectangular shape. The contact film 260 comprises an insulation film (support portion) 262 and a conductive portion 264 formed on the insulation film 262. The insulation film 262 is positioned between the elastic-support member 220 and the conductive portion 264. The conductive portion 264 faces the opening 110, and extends over the upper end 222, the attachment surface 226 and the lower end 224 of the elastic-support member 220. Therefore, the conductive portion 264 connects the upper end 222 of the elastic-support member 220 with the lower end 224 of the elastic-support member 220.

A length of the conductive portion 264 of the present embodiment is longer than an interval (L2: see FIG. 2) between the elastic-support members 220 in the X direction and the Y direction. As a result, the elastic-support member 220 which has a large size in the Z direction can be used for the connector 10. According to the present embodiment, each of the contacts 200 can be connected with the upper and the lower connection objects (the pads of the board or the pads of the LGA package) with sufficient contact pressure.

The attachment surface 226 of the elastic-support member 220 is a convexly curved-surface in the predetermined direction P. The rear-surface 228 of the present embodiment has also a convexly curved-surface in the predetermined direction P. In other words, each of the cross-sections of the attachment surface 226 and rear surface 228 has an arc-shape in a plane defined by the predetermined direction P and the Z direction. The elastic-support member 220 has the convexly curved-surface so that stress does not concentrate on a part (for example, the conductive portion 264) of the contact film 260 when the contact film 260 is attached to the elastic-support member 220 (described later).

The above-described base member 100 is made of the metal, however, the material is not limited to the metal. For example, the base member 100 may be made of an insulation material (polyimide film or resin sheet or the like) as long as the insulation material has higher stiffness than the elastic-support member 220. The surface of the base member 100 is coated with insulation material so that short circuit, for example, between the base member 100 and the conductive portion 264 of the contact 200 may not occur.

The base member 100 has a central area and a peripheral area 150 enclosing the central area. The openings 110 are formed on the central area. Eight positioning holes 152 are formed on the peripheral area 150. In detail, the positioning holes 152 are positioned in the vicinity of the four corners and middle parts of the four sides of the peripheral area 150 of the base member 100. The positioning holes 152 correspond to the positioning projections 302 of the frame 300. As understood from FIG. 1 and FIG. 2, the base member 100 is symmetric with respect to each of two diagonal lines. The arrangement of the matrix form of the base member 100 is made of seven columns and seven rows, i.e., the number of the columns is same as that of the rows. The arrangement of the contacts 200 is not changed even after the connector 10 is rotated 180 degrees around an axis in parallel to the Z direction (see FIG. 1). Therefore, it is sufficient that the number of the positioning holes 152 is two. However, the number of the positioning hole 152 may be three or more. Especially, if the numbers of the columns and the rows of the contacts 200 are different from each other, it is preferred that three or more positioning holes 152 are provided, or that two positioning holes 152 is provided and the connector 10 is formed so as to have an asymmetrical shape with respect to a line linking two positioning holes 152.

Figure 15:
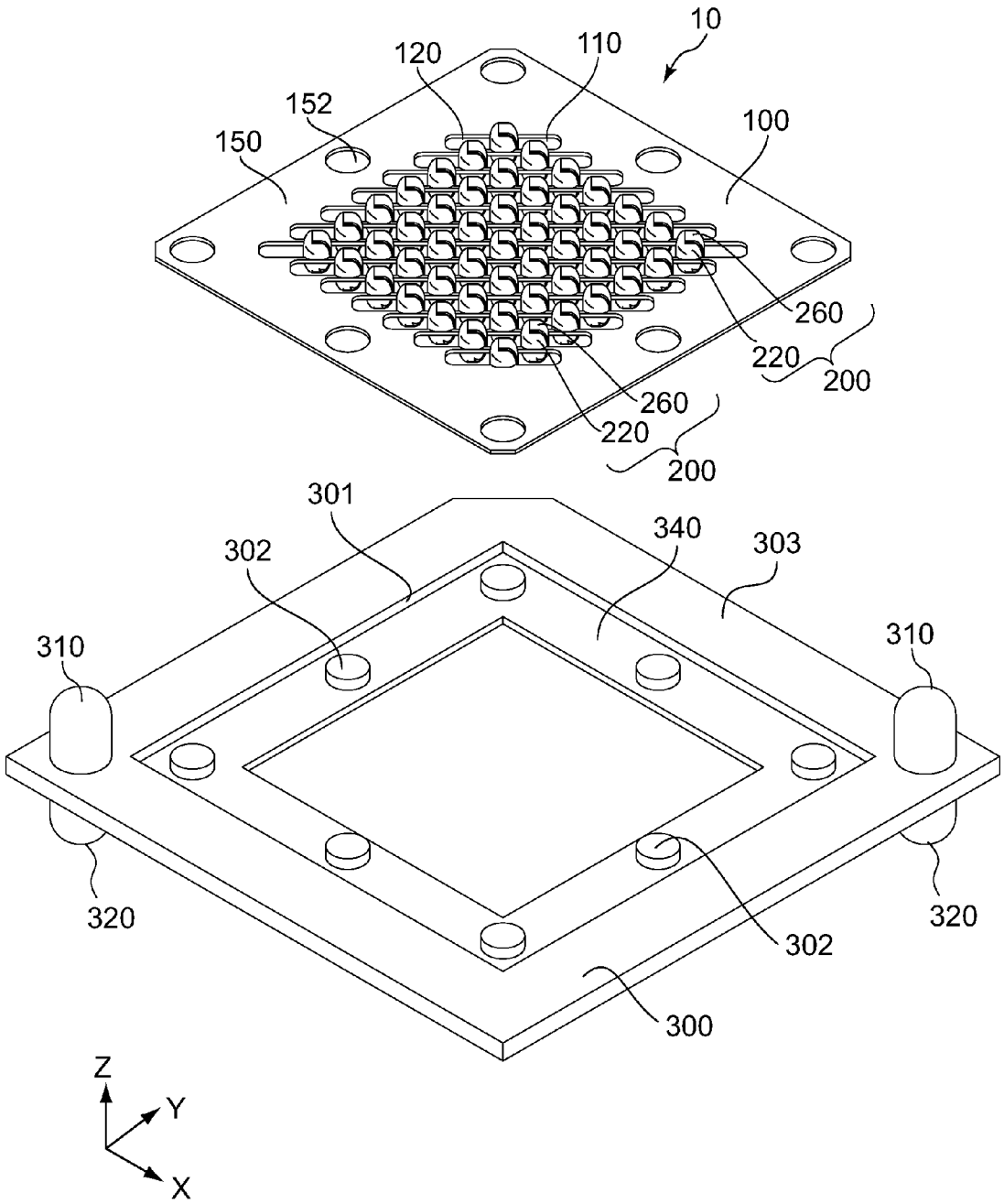
FIG. 15 is an oblique view showing the base member of FIG. 3, the contact of FIG. 3 and a frame.

As shown in FIG. 1 and FIG. 15, the frame 300 holds and fixes the base member 100. The frame 300 has a square-shape. The frame 300 has an opening formed at the center and a receiving portion 340 which holds the base member 100. The receiving portion 340 is formed around the opening and recessed downwards from an upper surface 303. Eight positioning projections 302 are formed on the receiving portion 340. The positioning projections 302 correspond to the positioning holes 152 of the base member 100. Height of the positioning projection 302 is preferred to be less than the upper surface 303. As shown in FIG. 16, the frame 300 of the present embodiment further has two positioning projections 310 and two positioning projections 320. The positioning projections 310 are inserted into the positioning holes 920 of the board 900 (the upper connection object) The positioning projections 320 are inserted into the positioning holes 970 of the board 950 (the lower connection object).

The base member 100 of the present embodiment is made of metal having high stiffness so that the positioning holes 152 may be omitted. In this case, a position-adjustment can be made by fitting an edge of the base member 100 to a side surface 301 (see FIG. 1 and FIG. 15) of the frame 300. The sizes of the receiving portion 340 and the base member 100 are preferably determined so that no clearance appears between the receiving portion 340 and the base member 100. However, the base member 100 made of the aforementioned insulation material or the like may be deformed (warped) when the edge of the base member 100 is fit to the side surface 301 of the frame 300. In this case, the position-adjustment is preferably made by using the positioning holes 152 of the base member 100 and the positioning projections 302 of the frame 300.

Hereinafter, an explanation will be made about a method for manufacturing the connector 10 which has the above-described structure with reference to the drawings.

With reference to FIG. 2, a square metal sheet is obtained, for example, by punching a metal-base member. The positioning holes 152 and the openings 110 (the rear-openings 120) are formed on the metal sheet. The positioning holes 152, the openings 110, and the rear-openings 120 may be formed by a laser process, a punching process or a press process or the like. The process of punching the metal-base member and the process of forming the positioning holes 152, the openings 110, and the rear-openings 120 may be carried out at one time.

Figure 5:
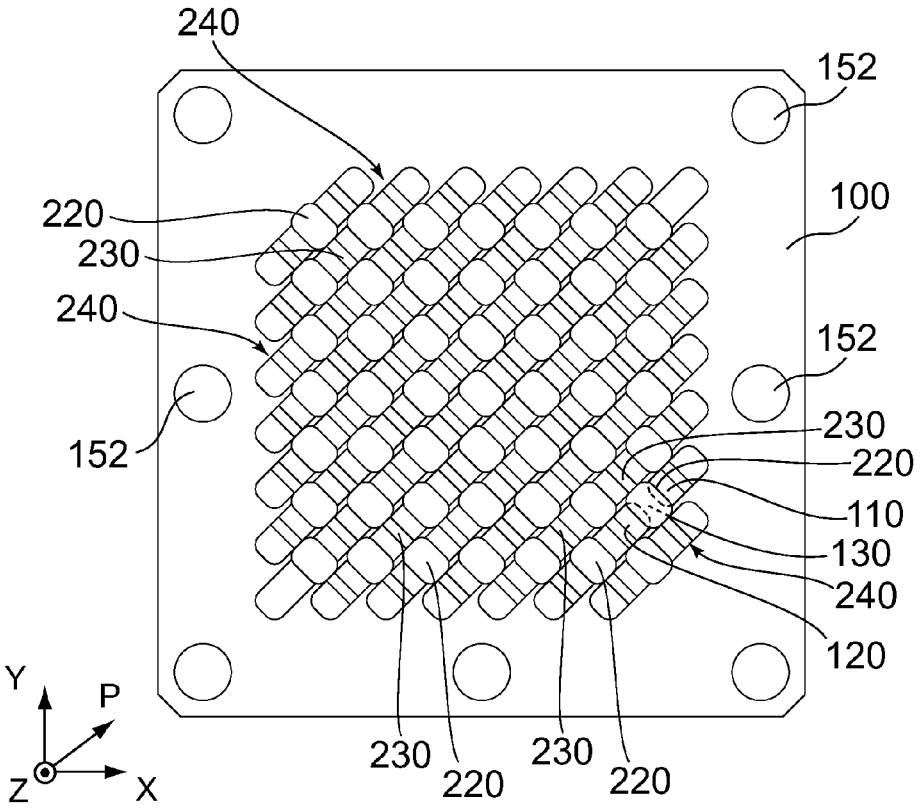
FIG. 5 is a top view showing the base member of FIG. 2. The base member is formed with an elastic-base member.
Figure 6:
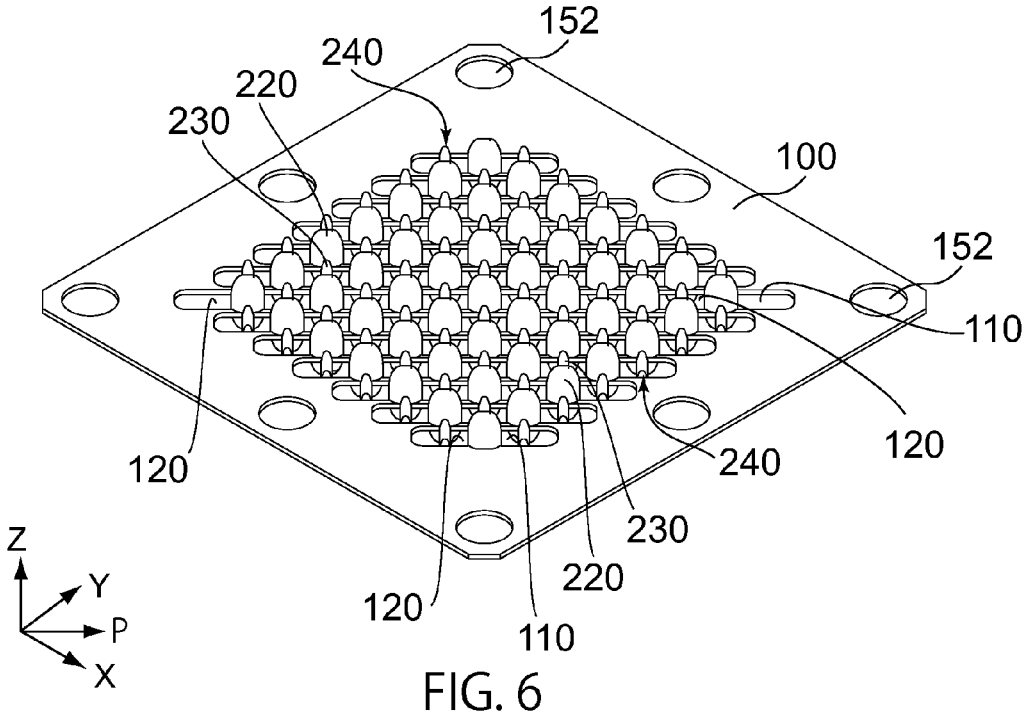
FIG. 6 is an oblique view showing the base member of FIG. 5.

Next, as shown in FIG. 5 and FIG. 6, elastic-base members 240 are formed to the base member 100 by an injection molding or the like. Each of the elastic-base members 240 is formed in a line in a direction perpendicular to the predetermined direction P. In detail, each of the elastic-base members 240 has the elastic-support member(s) 220 and connection portions 230. The elastic-support member 220 encloses the contact-attachment portion 130 of the base member 100. The connection portion 230 connects between the elastic-support members 220 neighboring in the direction perpendicular to the predetermined direction P. The connection portion 230 is thinner than the elastic-support member 220.

Figure 7:
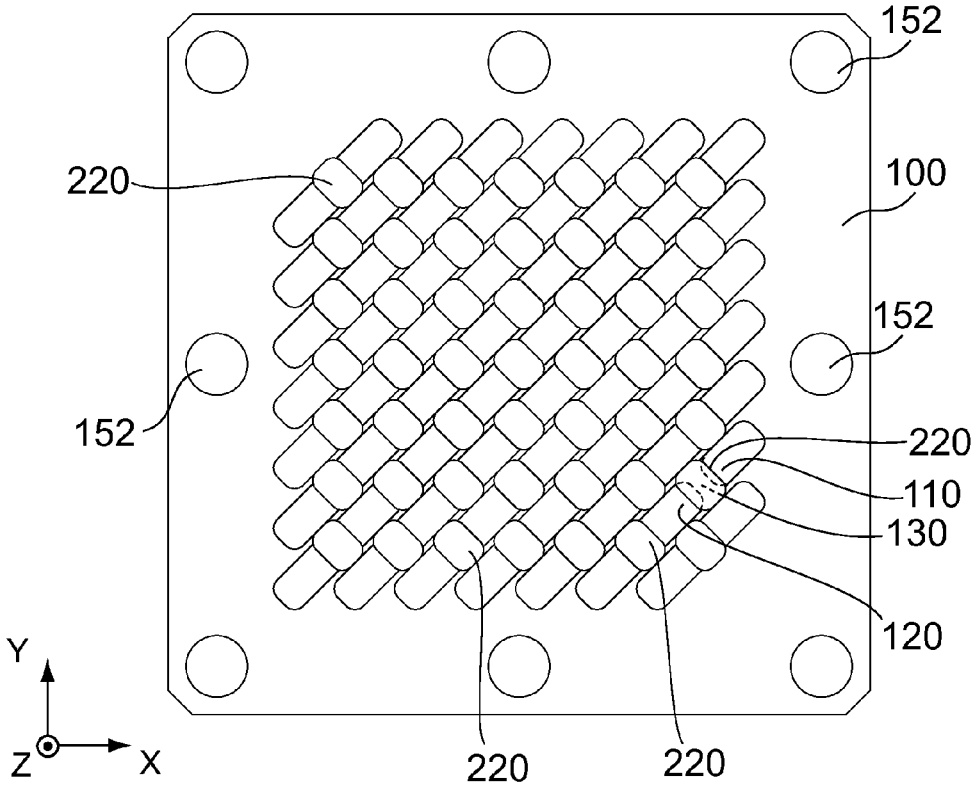
FIG. 7 is a top view showing the base member of FIG. 5. Connection portions are removed.
Figure 8:
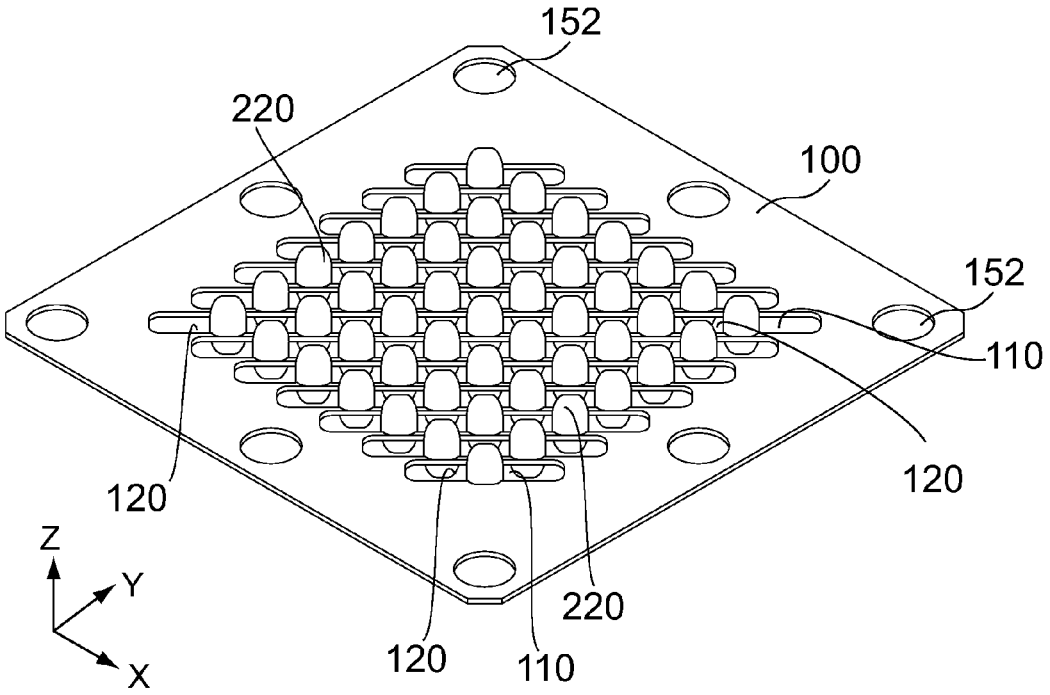
FIG. 8 is an oblique view showing the base member of FIG. 7.

After that, as shown in FIG. 7 and FIG. 8, the connection portions 230 are removed from the elastic-base member 240. The connection portions 230 may be removed by a laser-cutting, press process or the like. As a result of undergoing the above-processes, the base member 100 which has the elastic-support members 220 attached to the contact-attachment portions 130 can be obtained. As understood from FIG. 4, the contact-attachment portion 130 is positioned at the center of the elastic-support member 220. The contact-attachment portion 130, i.e. a part of the base member 100, is entirely embedded in the elastic-support member 220. In the present embodiment, the elastic-support members 220 are obtained by removing the connection portions 230 from the elastic-base member 240, however, the elastic-support members 220 may be directly formed to the corresponding contact-attachment portions 130.

With reference to FIG. 7 and FIG. 8, an explanation will be made about a process for pasting the contact film 260 to the elastic-support member 220. As shown in FIG. 4, adhesive is put on the upper end 222 and the lower end 224, and the contact film 260 is pasted on and adhered to the elastic-support member 220.

Figure 9:
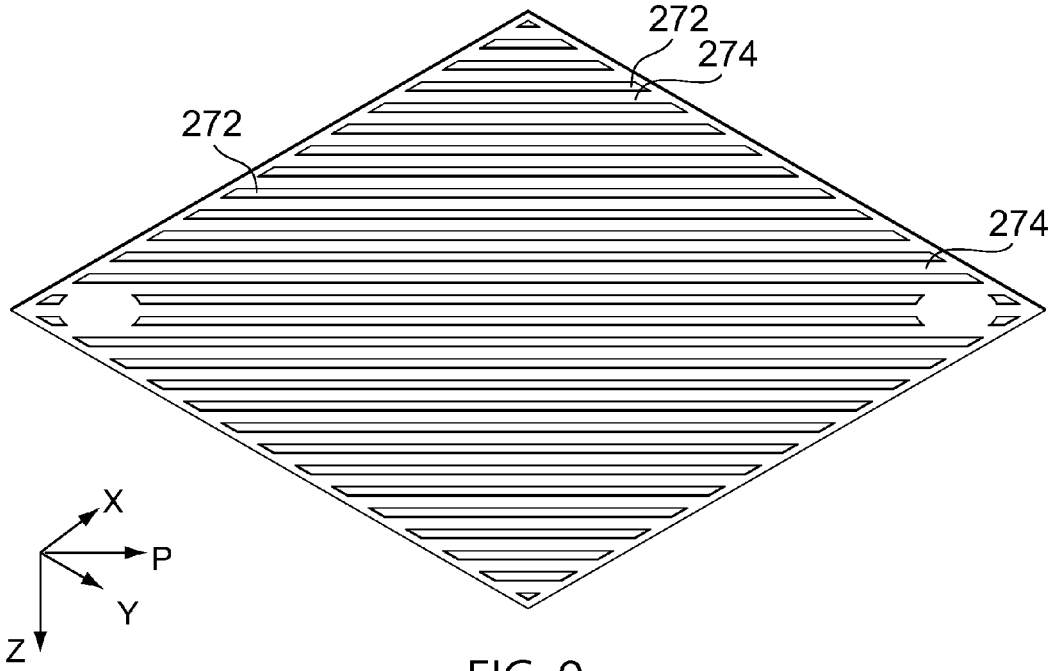
FIG. 9 is an oblique view showing an insulation-film base member formed with a conductive-portion base member.

The contact films 260 are pasted on the corresponding elastic-support members at one time by using a jig and a sheet on which a plurality of the contact films 260 are formed. In detail, as shown in FIG. 9, a conductive pattern including a plurality of conductor-base members 274 is formed on an underside of the insulation-film base member 272 (i.e., one of surfaces of the insulation-film base member 272). The conductive pattern of the present embodiment is formed by photolithography or plating and is made from a multilayer film (metal film) of Au/Ni/Cu or the like. As clear from FIG. 9, each of the conductor-base members 274 extends in the predetermined direction P.

Figure 10:
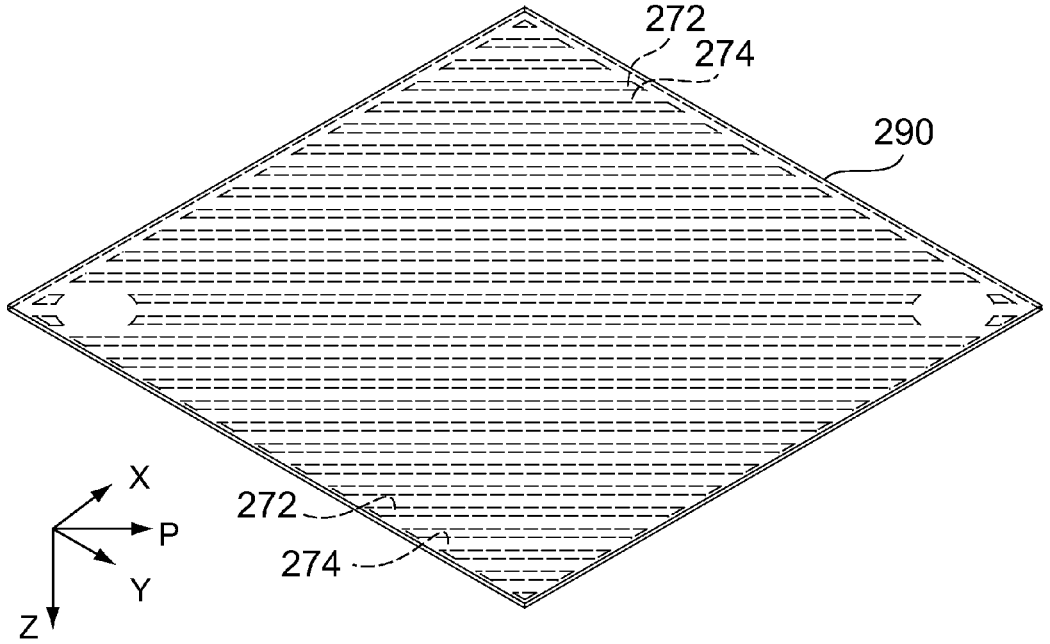
FIG. 10 is an oblique view showing the insulation-film base member of FIG. 9 formed with a protection member.

As shown in FIG. 10, a protection member 290 is pasted to an insulation-film base member 272 to cover the conductor-base member 274 in order to protect the conductor-base member 274. The protection member 290 is a protection tape or a protection sheet which has an adhesive side. By pasting the protection member 290, a total thickness becomes larger so that the handling of the sheet can be improved.

Figure 11:
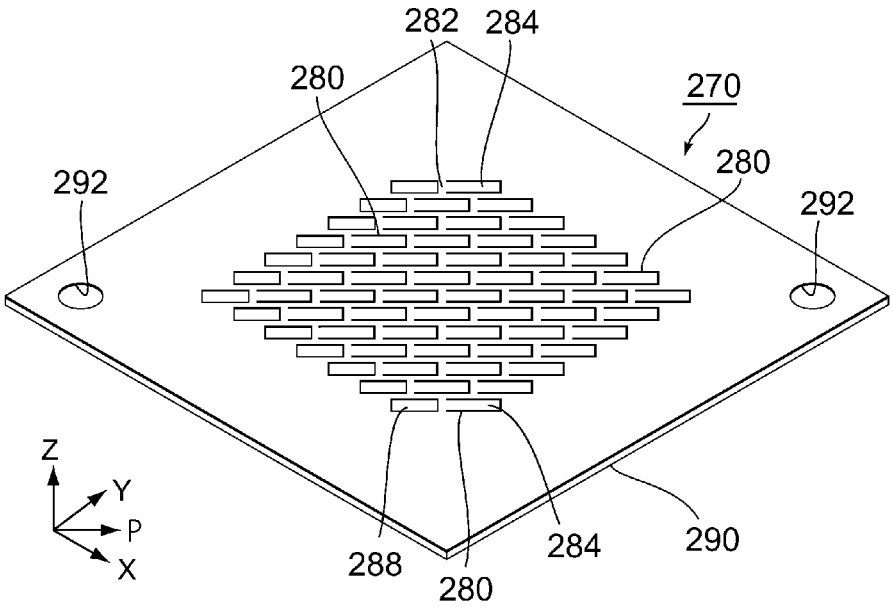
FIG. 11 is an oblique view showing a contact-film base member.

As shown in FIG. 11, cuts 280, the positioning holes 292 and rectangular holes 288 are formed on an upper side of the insulation-film base member 272 (i.e. the opposite side of the underside). In detail, the press process or the laser process is carried out for the upper side of the insulation-film base member 272 so that a plurality of the cuts 280 is formed. The upper side of the insulation-film base member 272 is formed with cuts corresponding to the positioning holes 292 and the rectangular holes 288. Then, unnecessary part in the holes is removed. The cuts 280 correspond to the openings 110 of the base member 100 (see FIG. 2). The rectangular holes 288 correspond to the rear-openings 120 which are not integrated with the openings 110. The positioning holes 292 correspond to the positioning holes 152 of the base member 100.

Figure 12:
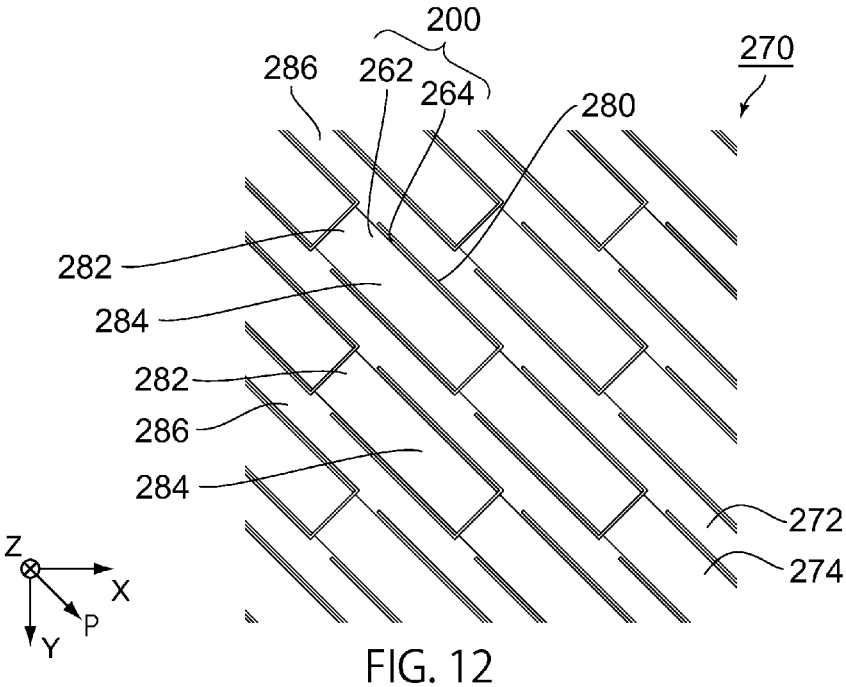
FIG. 12 is a partially enlarged, top view showing the contact-film base member of FIG. 11.

In detail, as shown in FIG. 12, the cut 280 has a rectangular U-shape. Two sides of the rectangular U-shape extend in the predetermined direction P, the remaining one side crosses the conductor-base member 274 and connects the above-described two sides. The conductor-base member 274 is divided by the cuts 280 so that a plurality of the conductive portions 264 is formed. The conductive portions 264 correspond to the elastic-support members 220 (see FIG. 3 and FIG. 12). Hereinafter, an area enclosed by the cuts 280 on three sides (i.e. an inner area of the rectangular U-shape) is called "a small piece 284", a part continuous to the small piece 284 is called "a fixing portion 282", and a part continuous to the fixing portion 282 and extending in the predetermined direction P is called "a supporting belt 286". The small pieces 284 and the fixing portions 282 correspond to the contact films 260 (see FIG. 3).

As shown in FIG. 12, the contact-film base member 270 provided with a plurality of the contact film 260 each of which comprises the insulation film 262 and the conductive portion 264 is obtained by making the cuts 280 on the insulation-film base member 272 and the conductor-base member 274. Afterwards, an adhesive is pasted on the upper end 222 and the lower end 224 of the elastic-support member 220. The fixing portion 282 of the contact-film base member 270 is adhered to the lower end 224. In the present embodiment, the positioning holes 292 of the contact-film base member 270 are adjusted to the positioning holes 152 of the base member 100 so that the lower ends 224 of elastic-support members 220 can be adjusted to the fixing portions 282 of the contact films 260. However, the lower ends 224 can be adjusted to the fixing portions 282 by another way. In the present embodiment, the adhesive is thermosetting adhesive. However, elastic adhesive or the like may be used.

Figure 13:
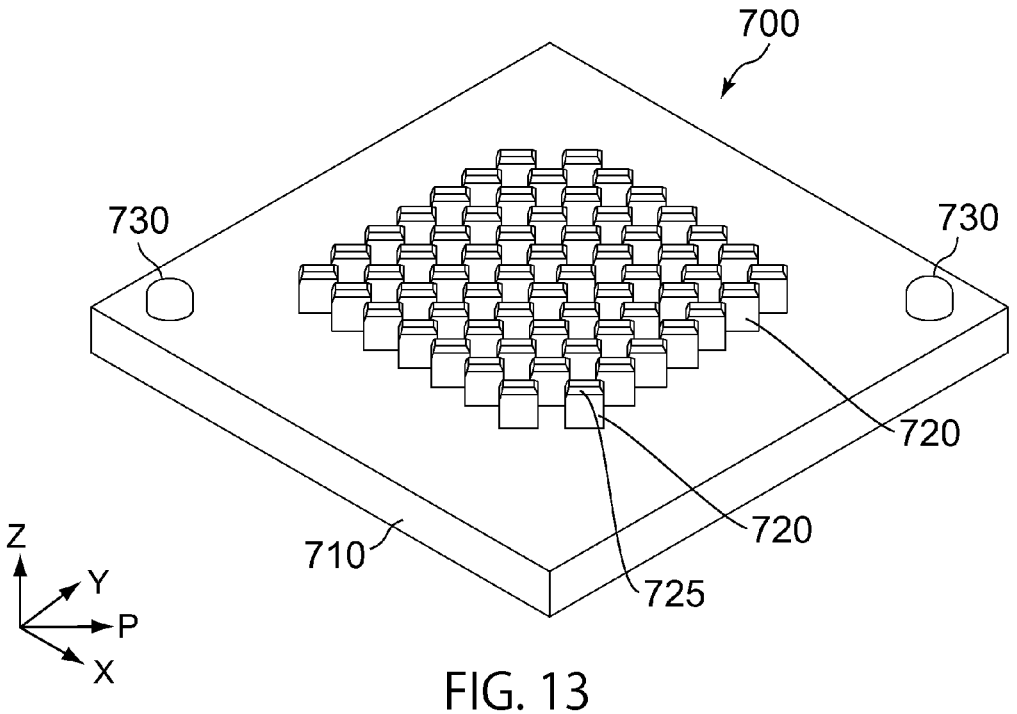
FIG. 13 is an oblique view showing a comb-jig.
Figure 14:
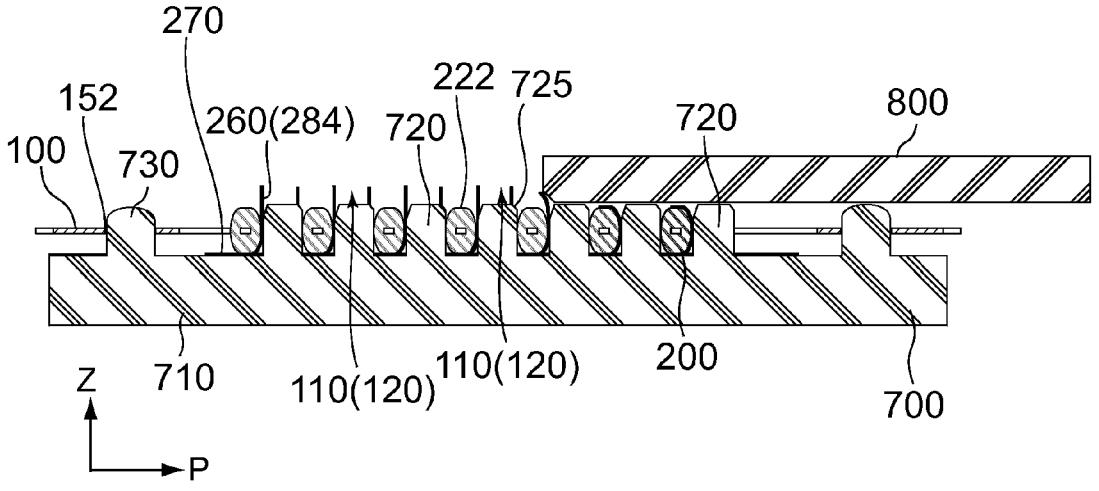
FIG. 14 is a cross-sectional view showing a process for forming the contact by using a bending-jig.

As shown in FIG. 13 and FIG. 14, a comb-jig 700 is set under the contact-film base member 270. In detail, the comb-jig 700 has a plate-like base 710 having a square shape, a plurality of comb-teeth 720 projecting in the +Z direction (upwards) from the base 710 and positioning projections 730. The comb-teeth 720 correspond to the openings 110. In other words, the comb-teeth 720 are arranged in a matrix form that has a plurality of columns in the X direction and a plurality of rows in the Y direction. Each of the comb-teeth 720 has a cross-section which has a rectangular shape extending in the predetermined direction P in the XY plane. Bevel portions 725 are formed on upper ends of the comb-teeth 720 so that the comb-teeth 720 are smoothly inserted into the openings 110. The height of the positioning projection 730 is no more than the height of the comb-teeth 720. The positioning projections 730 correspond to the positioning holes 292 (see FIG. 11) of the contact-film base member 270 and are positioned on an extended line of the diagonal line of the matrix form of the comb-teeth 720.

As shown in FIG. 12 to FIG. 14, the comb-teeth 720 of the comb-jig 700 are inserted into the openings 110 of the base member 100 from the underside (in the −Z direction), and the positioning projections 730 are inserted into the positioning holes 292 (see FIG. 11) of the contact-film base member 270 and the positioning holes 152 positioned on the diagonal line of the base member 100. As understood from FIG. 14, the small piece 284 is bent upwards (in the +Z direction) along the attachment surface 226 (see FIG. 4) by the comb-teeth 720 and projects upwards (in the +Z direction) from the upper end of the comb-teeth 720. As a result, the lower half part of the contact 200 is formed.

A bending-jig 800 which has a flat and large bottom surface is slid on the comb-teeth 720 of the comb-jug 700 so that the projected parts of the small pieces 284 are bent toward the elastic-support member 220. The bent parts of the small pieces 284 are adhered to the upper ends 222 of the elastic-support members 220. In order to smoothly slide the bending-jig 800, a guide member may be used for guiding the bending-jig 800. The comb-jig 700 and the bending-jig 800 are fixed to each other under the state where the bending-jig 800 covers all of the comb-teeth 720. Afterwards, the adhesive pasted on the upper end 222 and the lower end 224 of the elastic-support member 220 is hardened. As described above, the adhesive of the present embodiment is the thermosetting adhesive. In the present embodiment, the connector 10 is sandwiched between the comb-jig 700 and the bending-jig 800. The connector 10, the comb-jig 700 and the bending-jig 800 are fixed by a clip or the like, and heated so that the adhesive is hardened. Finally, the comb-jig 700 and the bending-jig 800 are removed.

As understood from that the contact-film base member 270 is positioned on the base 710 of the comb-jig 700 in FIG. 14, in this state, the fixing portions 282 of the contact-film base member 270 are connected with the supporting belts 286 (see FIG. 11 and FIG. 12). In the present embodiment, the rectangular cuts 280 extend in the predetermined direction P. The small pierce 284 is larger than the fixing portion 282, i.e., a connection portion between the fixing portion 282 and the supporting belt 286 is small. With this structure, the supporting belt 286 is separated from the fixing portions 282 at one time by peeling the supporting belt 286 in the predetermined direction P after removing the comb-jig 700. As a result, as shown in FIG. 15, a structure (a connector intermediate) comprising the base member 100 and the contacts can be obtained.

As shown in FIG. 15, position-adjustment between the base member 100 and the frame 300 is made by inserting the positioning projection 302 of the frame 300 into the corresponding positioning holes 152 of the base member 100. The base member 100 may be fixed to the frame 300, for example, by press-fitting, laser welding, the potting of the adhesive and directly pasting with the adhesive.

Figure 17:
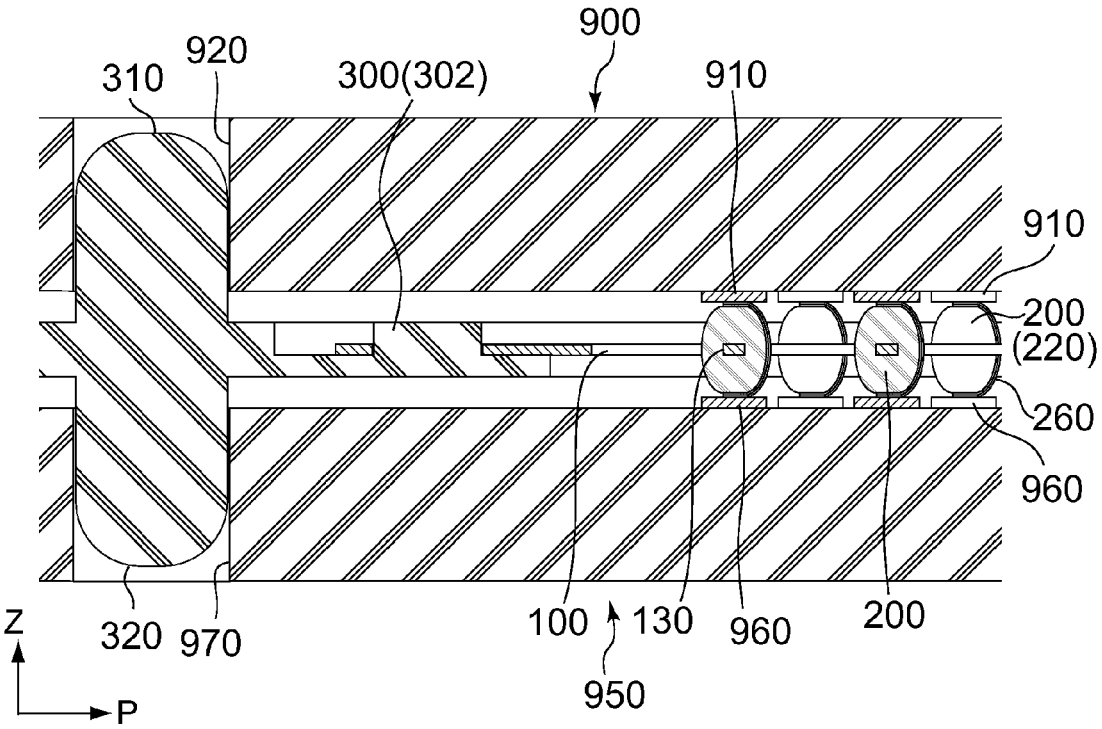
FIG. 17 is a cross-sectional view showing the connector which is put between the upper board and the lower board.

As shown in FIG. 16 and FIG. 17, the connector 10 is used between the board 900 and the board 950. The positioning projections 310 of the frame 300 are inserted into the positioning holes 920 of the board 900. The positioning projections 320 are inserted into the positioning holes 970 of the board 950. As best shown in FIG. 17, the pads 910 of the board 900 are electrically connected with the pads 960 of the board 950 through the conductive portions 264 (see FIG. 4). In addition, when the upper side of the board 900 and the underside of the board 950 are pressed, the contacts 200 is resiliently deformed so that the sufficient contact pressure can be obtained by restoring force. The opening 110 and the rear-opening 120 are provided at a front and a rear of the contact 200 so that the contact 200 can deform frontwards and rearwards in the predetermined direction P. In other words, a deformation volume of the attachment surface 226 of the contact 200 can be minimized as compared with the base member provided with only the opening 110. The conductive portion 264 is prevented from breaking as the contact 200 is deformed. A holding means which holds a connection state (i.e. a state where the contacts 200 are resiliently deformed) may be provided to the connector 10.

Second Embodiment

Figure 18:
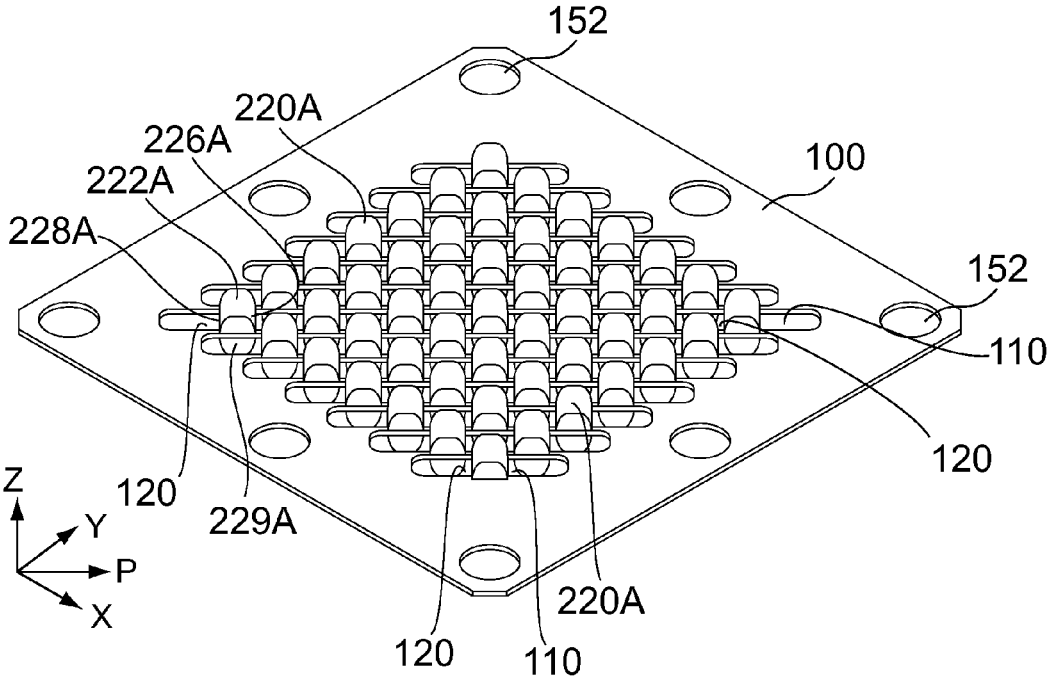
FIG. 18 is an oblique view showing a connector according to a second embodiment of the present invention. The base member is formed with elastic-support members.
Figure 19:
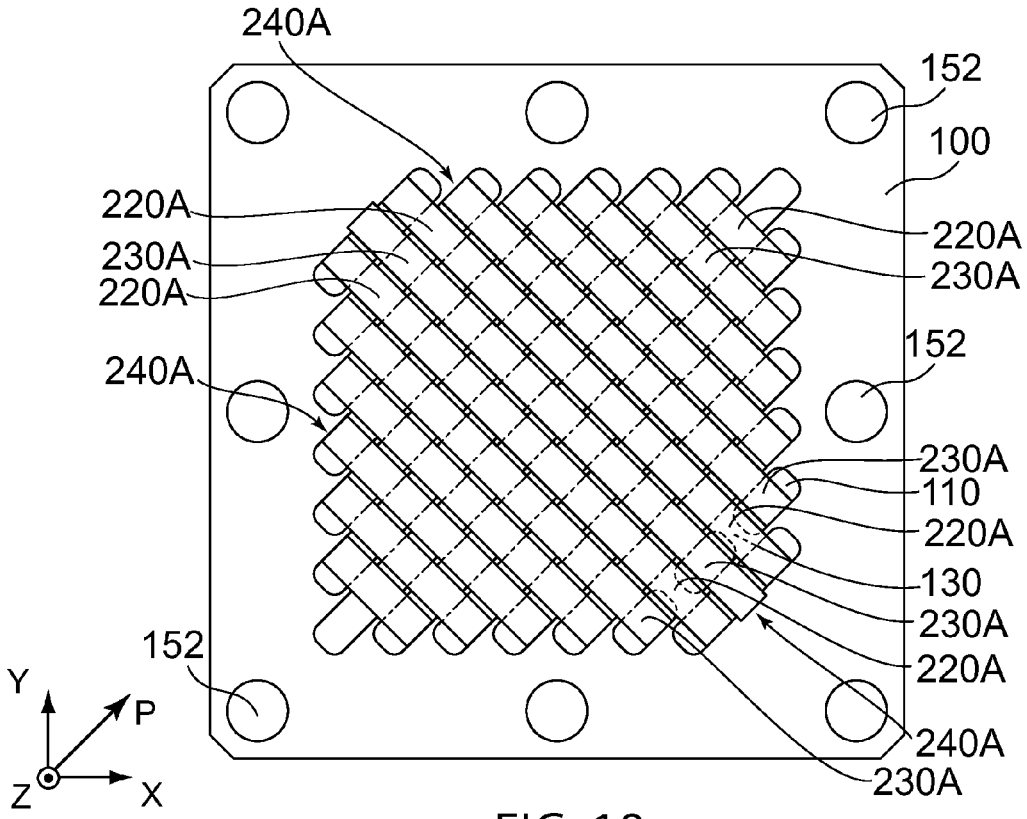
FIG. 19 is a top view showing a process for forming the elastic-support member. The base member is formed with an elastic-base member.
Figure 20:
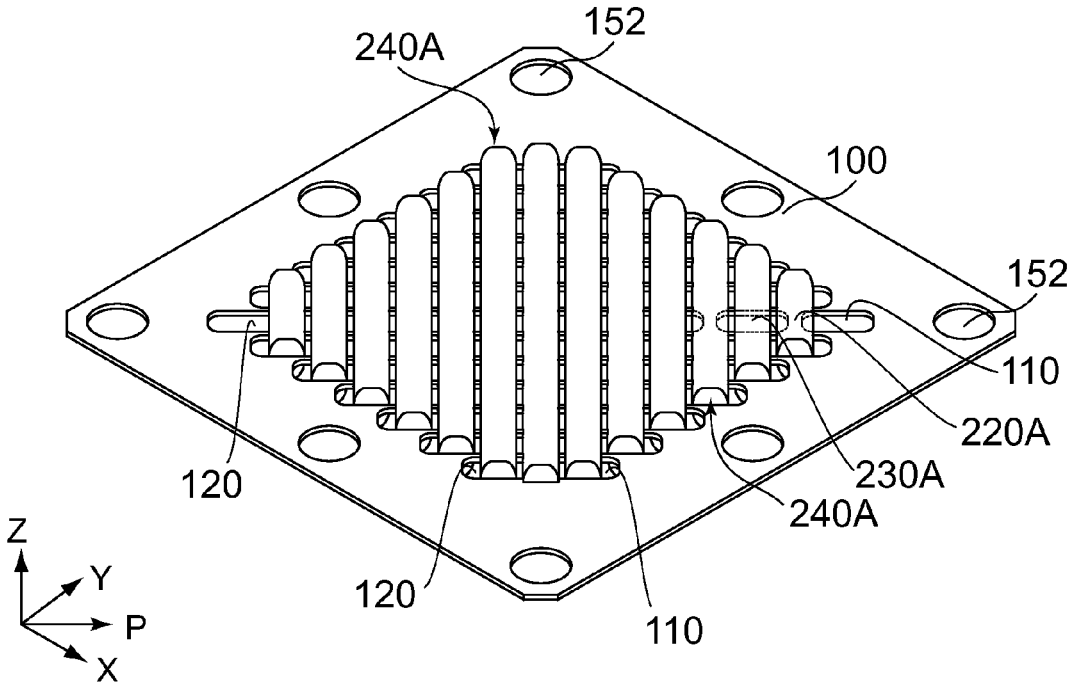
FIG. 20 is an oblique view of FIG. 19.

As shown in FIG. 18 to FIG. 20, the second embodiment of the present invention relates to a variation example of a shape of the elastic-support member 220 of the contact 200 of the first embodiment (see FIG. 1). Therefore, the contact film 260, the base member 100 and the frame 300 (not shown) of the first embodiment are used for the second embodiment, therefore, an explanation about these components will be omitted. Similarly, the method for manufacturing the base member 100 and the process after the process for attaching the elastic-support members 220A to the contact-attachment portions 130 is same as that of the first embodiment. Therefore, an explanation will be made about the process for forming the elastic-base member 240A to the base member 100 and forming the elastic-support member 220A.

As shown in FIG. 18, the elastic-support member 220A of the present embodiment has an elliptic cylinder shape and is attached to the contact-attachment portion 130 of the base member 100. The elastic-support member 220A has an upper end 222A, an attachment surface 226A, a lower end (not shown) and a rear surface 228A. The upper end 222A and the lower end (not shown) are opposite ends of the elastic-support member 220A in the Z direction (in the vertical direction). The attachment surface 226A is positioned between the upper end 222A and the lower end 224A. The rear surface 228A is positioned opposite to the attachment surface 226A in the predetermined direction P. In the present embodiment, the elastic-support member 220A has a side surface 229A in parallel with a plane defined by the Z direction and the predetermined direction P.

Similarly to the first embodiment, the elastic-support members 220A project upwards (in the +Z direction) and downwards (in the −Z direction). In other words, the upper end 222A and the lower end 224A of each of the elastic-support members 220A are distant from the base member 100. The contacts 200 absorb variations of sizes in the Z direction of pads of the connection objects (the board 900, 950: see FIG. 16) which are positioned on and under the contacts 200. Therefore, each of the contacts 200 is connected with each of the pads with reliability. The attachment surface 226A of the elastic-support member 220A faces the opening 110, the rear surface 228A faces the rear-opening 120. In other words, the elastic-support member 220A is positioned between the opening 110 and the rear-opening 120 in the predetermined direction P.

The elastic-support member 220A is manufactured as follows. As shown in FIG. 19 and FIG. 20, elastic-base members 240A are formed to the base member 100 by an injection molding. As shown in FIG. 19, each of the elastic-base members 240A is formed in a line in a direction perpendicular to the predetermined direction P. In detail, each of the elastic-base members 240A has the elastic-support member(s) 220A and a connection portion 230A. The elastic-support members 220A enclose the contact-attachment portions 130 of the base member 100. The connection portion 230A connects the elastic-support members 220A neighboring in the direction perpendicular to the predetermined direction P. The connection portion 230A of the present invention has the same diameter (shape) of the elastic-support member 220A.

After that, as shown in FIG. 18 and FIG. 19, the connection portions 230A are removed from the elastic-base member 240A. The connection portions 230A may be removed by a laser-cutting, press process or the like. As a result of the above-processes, the base member 100 which has the elastic-support members 220A attached to the contact-attachment portions 130 is obtained. Similarly to the first embodiment, the contact-attachment portion 130 is positioned at the center of the elastic-support member 220A. The contact-attachment portion, i.e. a part of the base member 100, is entirely embedded in the elastic-support member 220A. According to this structure, the elastic-support member 220 is positioned with accuracy in the X direction and the Y direction. The elastic-support members 220 are securely held and prevented from sliding from the contact-attachment portions 130. In the present embodiment, the elastic-support members 220A are obtained by removing the connection portion 230A from the elastic-base member 240A. However, the elastic-support members 220A may be directly formed to the corresponding contact-attachment portions 130.

Third Embodiment

Figure 21:
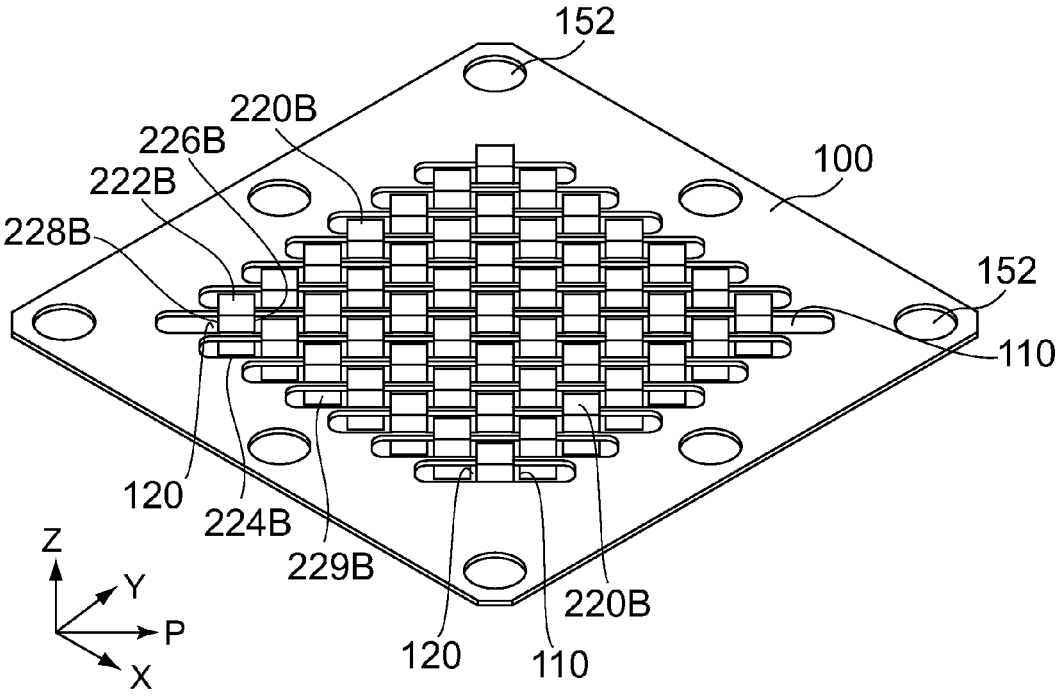
FIG. 21 is an oblique view showing a connector according to a third embodiment of the present invention. The base member is formed with elastic-support members.
Figure 22:
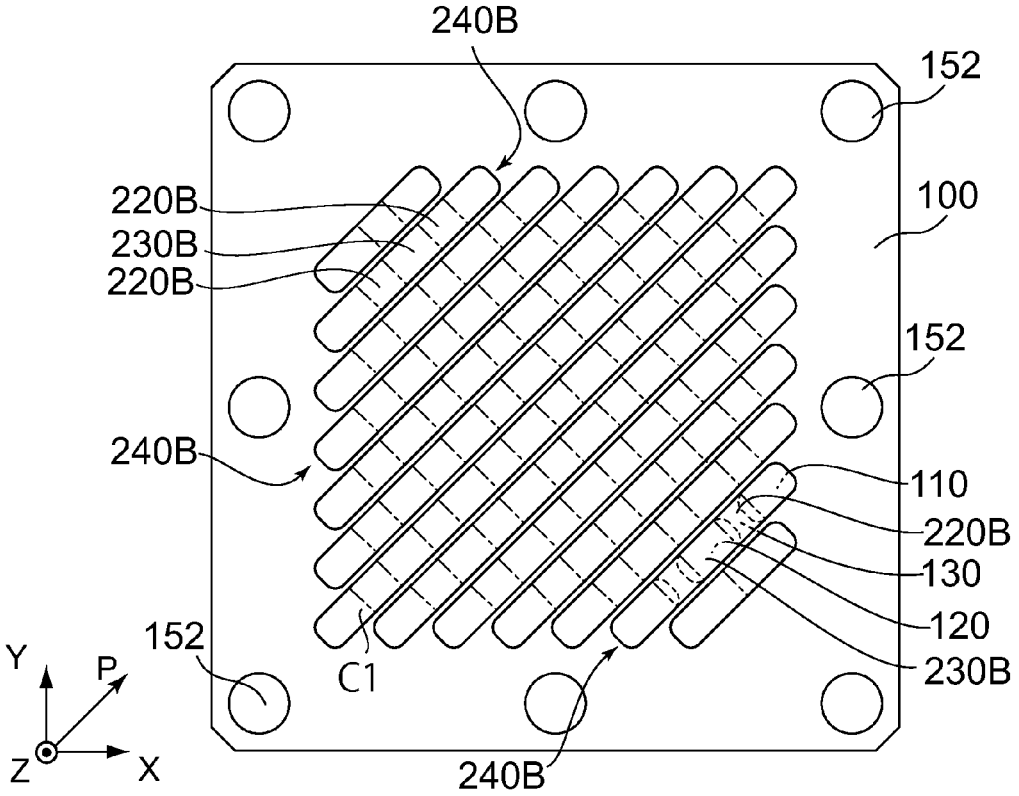
FIG. 22 is a top view showing a process for forming the elastic-support member. The base member is formed with the elastic-base members.
Figure 23:
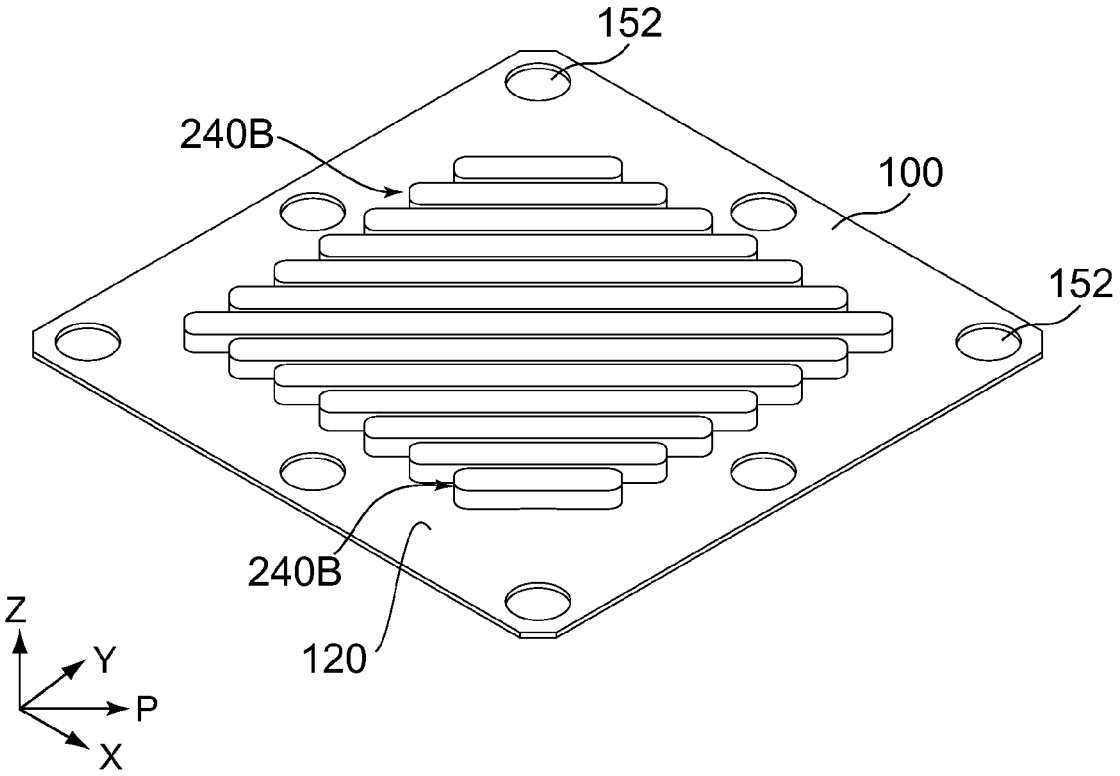
FIG. 23 is an oblique view of FIG. 22.
Figure 24:
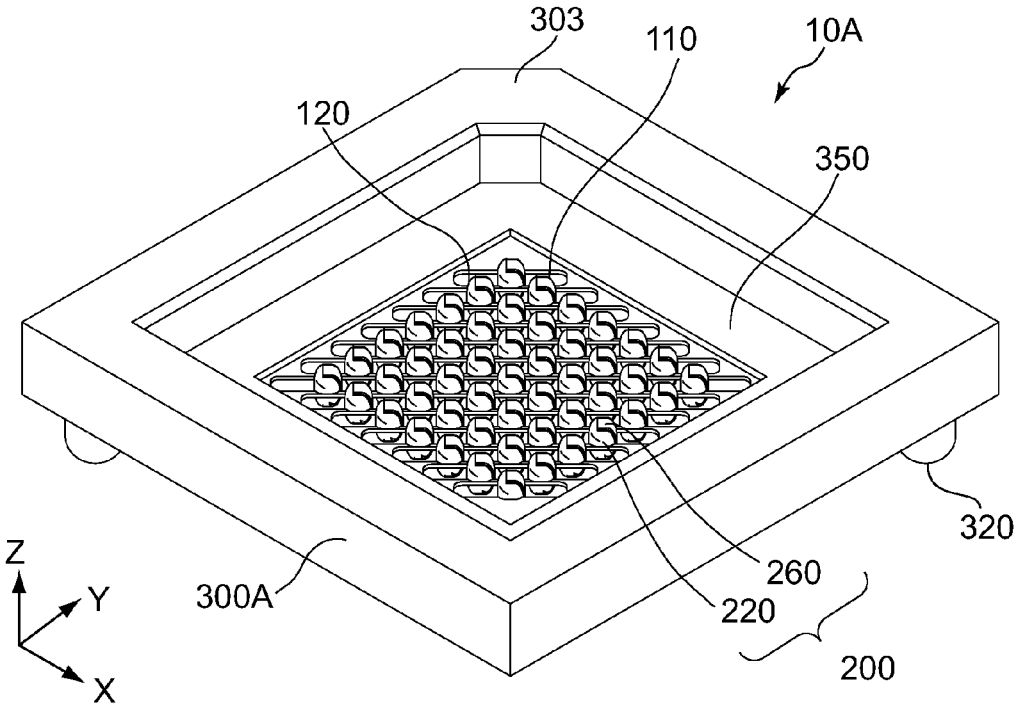
FIG. 24 is an oblique view showing a connector according to a fourth embodiment of the present invention. An upper side of the connector is illustrated.
Figure 25:
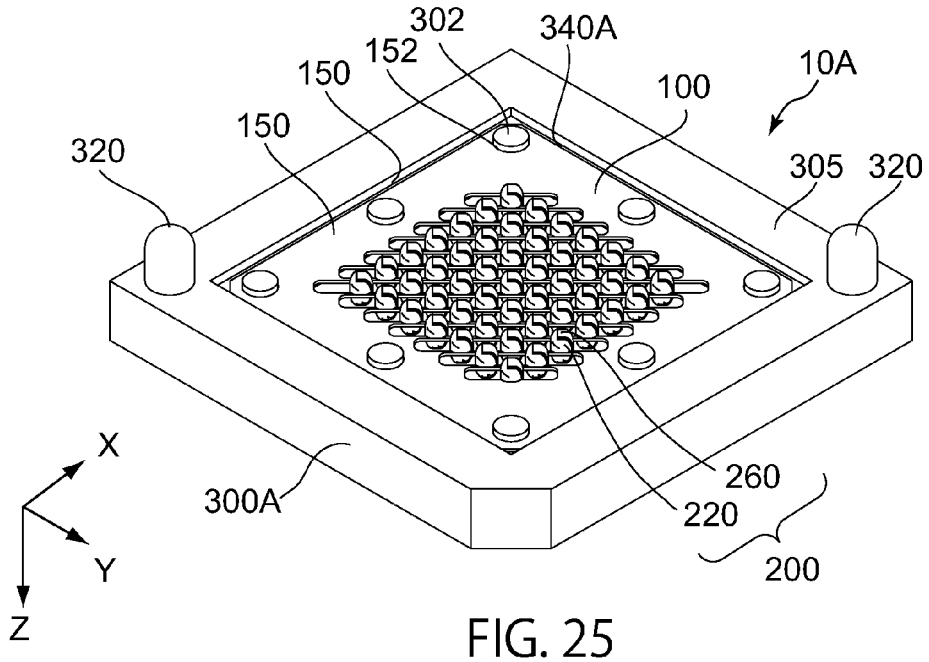
FIG. 25 is an oblique view showing an under side of the connector of FIG. 24.

As shown in FIG. 21 to FIG. 23, the third embodiment of the present invention is relates to a variation example of a shape of the elastic-support member 220 of the contact 200 (see FIG. 1). Therefore, the contact film 260, the base member 100 and the frame 300 (not shown) of the first embodiment are used for the second embodiment, therefore, an explanation about these components will be omitted. Similarly, the method for manufacturing base member 100 and the process after the process for attaching the elastic-support members 220B to the contact-attachment portions 130 is same as that of the first embodiment, therefore, an explanation will be made about the process for forming the elastic-base member 240B to the contact-attachment portions 130 and forming the elastic-support member 220B.

As shown in FIG. 21, the elastic-support member 220B of the present embodiment has an elliptic-circle shape and is attached to the contact-attachment portion 130 of the base member 100. The elastic-support member 220B has an upper end 222B, an attachment surface 226B, a lower end (not shown) and a rear surface 228B. The upper end 222B and the lower end (not shown) are opposite ends of the elastic-support member 220B in the Z direction (in the vertical direction). The attachment surface 226B is positioned between the upper end 222B and the lower end 224B. The rear surface 228B is positioned opposite to the attachment surface 226B in the predetermined direction P. In the present embodiment, the elastic-support member 220B has a side surface 229B in parallel with a plane defined by the Z direction and the predetermined direction P.

Similarly to the first embodiment, the elastic-support members 220B project upwards (in the +Z direction) and downwards (in the −Z direction). In other words, the upper end 222B and the lower end 224B of each of the elastic-support members 220B are distant from the base member 100. The contacts 200 absorb variations of sizes in the Z direction of pads of the connection objects (the board 900, 950: see FIG. 16) which are positioned on and under the contacts 200. Therefore, each of the contacts 200 is connected with each of the pads with reliability. The attachment surface 226B of the elastic-support member 220B faces the opening 110, and the rear surface 228B faces the rear-opening 120. In other words, the elastic-support member 220B is positioned between the opening 110 and the rear-opening 120.

The elastic-support member 220B is manufactured as follows. As shown in FIG. 22 and FIG. 23, elastic-base members 240B are formed to the base member 100 by an injection molding. As shown in FIG. 19, each of the elastic-base members 240B is formed in a line in the direction perpendicular to the predetermined direction P. In detail, each of the elastic-base members 240B has the elastic-support member(s) 220B and a connection portion 230B. The elastic-support members 220B enclose the contact-attachment portions 130 of the base member 100. The connection portion 230B connects the elastic-support members 220B neighboring in the direction perpendicular to the predetermined direction P. The connection portion 230B of the present embodiment has the same diameter (shape) as the elastic-support member 220B.

After that, the connection portions 230B are removed from the elastic-base member 240B. The connection portions 230B may be removed by a laser-cutting, press process or the like, taken along a cutting line C1 shown in FIG. 22. As a result of the above-processes, the base member 100 which has the elastic-support members 220B formed to the contact-attachment portions 130 is obtained. Similarly to the first embodiment, the contact-attachment portion is entirely embedded in the elastic-support member 220B so that the elastic-support member 220 is positioned with accuracy in the X direction and in the Y direction. Accordingly the elastic-support member 220 is securely held by the base member 100. The elastic-support members 220B of the present embodiment are obtained by removing the connection portion 230B from the elastic-base member 240B (see FIG. 22). However, the elastic-support members 220B may be directly formed to the corresponding contact-attachment portions 130.

Fourth Embodiment

The fourth embodiment of the present invention is related to a variation example of the frame 300 of the connector 10. As shown in FIG. 24 to FIG. 27, a connector 10A comprises a frame 300A. The base member 100 and the contact 200 of the first embodiment of can be used for the connector 10A of the present embodiment, thus, the same numerals are given to those components, thus, explanations of the structures and the manufacturing methods of these components will be omitted.

The frame 300A has a receiving portion 350 (see FIG. 24) formed on the upper surface 303 and a receiving portion 340A (see FIG. 25) formed on the under surface 305. The receiving portion 350 receives an LGA package 1000 while the receiving portion 350A receives the connector 10A. As shown in FIG. 26, the LGA package 1000 is received in the receiving portion 350 so that pads 1010 of the LGA package 1000 is adjusted, in position, to the contacts 200. In this state, when the underside of the board 950 and the upper side of the LGA package 1000 are pressed, the contacts 200 are deformed so that the sufficient contact pressure can be obtained by restoring force. As a result, the pads 960 are electrically connected with the corresponding pads 1010 through the contacts 200.

The present application is based on a Japanese patent application of JP2012-143353 filed before the Japan Patent Office on Jun. 26, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a base member having a plurality of contact-attachment portions and a plurality of openings, the plurality of contact-attachment portions being arranged in a matrix form that has a plurality of columns in a first horizontal direction and a plurality of rows in a second horizontal direction crossing the first horizontal direction, the plurality of openings corresponding to the plurality of contact-attachment portions, each of the plurality of openings piercing the base member in a vertical direction perpendicular to both the first horizontal direction and the second horizontal direction, and each of the plurality of openings extending in a predetermined direction crossing both the first horizontal direction and the second horizontal direction in a horizontal plane which is defined by the first horizontal direction and the second horizontal direction; and a plurality of contacts held by the base member and arranged in the matrix form, each of the plurality of contacts comprising an elastic-support member and a contact film, the elastic-support member having an upper end, an attachment surface and a lower end, the upper end and the lower end being opposite ends of the elastic-support member in the vertical direction, the attachment surface being positioned between the upper end and the lower end and facing a corresponding one of the plurality of openings, the elastic-support member being attached to a corresponding one of the contact-attachment portions and projecting upwards and downwards from the base member, the contact film comprising an insulation film and a conductive portion formed on the insulation film, the insulation film being positioned between the elastic-support member and the conductive portion, and the conductive portion facing the corresponding one of the plurality of openings and extending over the upper end, the attachment surface and the lower end of the elastic-support member.

2. The connector as recited in claim 1, wherein at least the attachment surface of the elastic-support member is a convexly curved-surface in the predetermined direction.

3. The connector as recited in claim 1, wherein the elastic-support member further has a rear surface positioned opposite to the attachment surface in the predetermined direction, the base member being formed with a plurality of rear-openings corresponding to the plurality of contact-attachment portions, the rear surface of the elastic-support member facing a corresponding one of the plurality of rear openings.

4. The connector as recited in claim 3, wherein one of the openings corresponding to one of the plurality of contact-attachment portions also serves as one of the rear-openings corresponding to another one of the plurality of contact-attachment portions.

5. The connector as recited in claim 1, wherein the base member is made of a material which has higher stiffness than the elastic-support member.

6. The connector as recited in claim 5, wherein the material which has higher stiffness is metal.

7. The connector as recited in claim 6, wherein the base member is obtained by coating a surface of the metal with an insulator.

8. The connector as recited in claim 1, wherein the base member has a rectangular shape constituted by two sides extending in the first direction and two sides extending in the second direction.

9. The connector as recited in claim 1, wherein a developed length of the conductive portion is longer than each of intervals between the plurality of contact-attachment portions in the first horizontal direction and the second horizontal direction.

10. The connector as recited in claim 1, wherein a size of the corresponding one of the plurality of openings in the predetermined direction is larger than each of intervals between the plurality of contact-attachment portions in the first horizontal direction and the second horizontal direction.

11. The connector as recited in claim 1, wherein the first horizontal direction is perpendicular to the second horizontal direction, the predetermined direction forming an angle of 45 degrees with both the first horizontal direction and the second horizontal direction.

12. The connector as recited in claim 1, further comprising a frame enclosing the base member on the horizontal plane.

13. The connector as recited in claim 12, wherein the base member has a central area and a peripheral area enclosing the central area on the horizontal plane, the plurality of openings being formed in the central area, a positioning hole being formed in the peripheral area, a positioning projection being formed on the frame, and the positioning projection being inserted in the positioning hole.

14. A fabrication method of a connector which has a plurality of contacts and a base member holding the plurality of contacts, comprising:

forming an elastic-base member to the base member, the base member having a plurality of contact-attachment portions and a plurality of openings, the plurality of contact-attachment portions being arranged in a matrix form that has a plurality of columns in a first horizontal direction and a plurality of rows in a second horizontal direction crossing the first horizontal direction, the plurality of openings corresponding to the plurality of contact-attachment portions, each of the plurality of openings piercing the base member in a vertical direction perpendicular to both the first horizontal direction and the second horizontal direction, each of the plurality of openings extending in a predetermined direction crossing both the first horizontal direction and the second horizontal direction in a horizontal plane which is defined by the first horizontal direction and the second horizontal direction, the elastic-base member having at least two elastic-support members and a connection portion which connects between the elastic-support members, each of the elastic-support members being attached to a corresponding one of the plurality of contact-attachment portions and having an upper end, a lower end and an attachment surface, the upper end and the lower end being opposite ends of the elastic support member in the vertical direction, and the attachment surface being provided between the upper end and the lower end and facing a corresponding one of the plurality of openings;

removing the connection portion;

preparing a plurality of contact films each of which has a support portion made of insulation material, and a conductive portion formed on the support portion; and forming the plurality of contacts by attaching the plurality of contact films to the elastic-support members so that the conductive portion faces the corresponding one of the plurality of openings and extends over the upper end, the attachment surface and the lower end of the elastic-support member.

* * * * *